US005904044A

United States Patent [19]

White

[11] Patent Number: 5,904,044

[45] Date of Patent: May 18, 1999

[54] FLUID EXPANDER

[76] Inventor: William M. White, 621 Hope Ave., Seneca, S.C. 29678

[21] Appl. No.: 08/808,947

[22] Filed: Feb. 19, 1997

[51] Int. Cl.[6] ..... F16D 31/02

[52] U.S. Cl. ..... 60/443; 123/56.1; 123/48 B; 123/48 C; 123/78 BA; 123/78 C; 91/504; 92/12.2

[58] Field of Search ..... 60/443, 659; 123/56.1, 123/56.2, 56.3, 56.4, 43 A, 44 D, 48 B, 48 L, 78 BA, 78 C; 91/499, 504, 505, 506; 92/12.1, 12.2

[56] References Cited

U.S. PATENT DOCUMENTS

| | | | |
|---|---|---|---|
| 225,651 | 3/1880 | Silver | 91/505 |
| 839,300 | 12/1906 | Krohn . | |
| 980,491 | 1/1911 | Coleman . | |
| 1,345,808 | 7/1920 | Reynolds . | |
| 1,968,694 | 7/1934 | Leibing . | |
| 3,654,906 | 4/1972 | Airas . | |
| 3,695,237 | 10/1972 | Londo . | |
| 3,886,734 | 6/1975 | Johnson . | |
| 3,939,809 | 2/1976 | Rohs . | |
| 3,968,776 | 7/1976 | Rund . | |
| 4,336,686 | 6/1982 | Porter . | |
| 4,413,486 | 11/1983 | Irwin . | |
| 4,458,480 | 7/1984 | Irwin . | |
| 4,779,579 | 10/1988 | Sukava et al. . | |
| 5,070,825 | 12/1991 | Morgan . | |
| 5,077,976 | 1/1992 | Pusic et al. . | |
| 5,080,050 | 1/1992 | Dale . | |
| 5,083,532 | 1/1992 | Wiesen . | |
| 5,085,054 | 2/1992 | Katsuda et al. . | |
| 5,088,284 | 2/1992 | Momose . | |
| 5,090,894 | 2/1992 | Riecke et al. . | |
| 5,094,083 | 3/1992 | Horn et al. . | |
| 5,094,195 | 3/1992 | Gonzalez . | |
| 5,095,699 | 3/1992 | Blackshear . | |
| 5,095,700 | 3/1992 | Bolger . | |
| 5,103,643 | 4/1992 | Ross . | |
| 5,103,775 | 4/1992 | Hue . | |
| 5,103,778 | 4/1992 | Usich, Jr. . | |
| 5,107,682 | 4/1992 | Cosby . | |
| 5,109,673 | 5/1992 | Vitale . | |
| 5,113,656 | 5/1992 | Swansen . | |
| 5,131,231 | 7/1992 | Trimble et al. . | |
| 5,134,848 | 8/1992 | Taniguchi et al. . | |
| 5,138,993 | 8/1992 | Kim . | |
| 5,140,818 | 8/1992 | Silvestri, Jr. et al. . | |
| 5,140,905 | 8/1992 | Dhar . | |
| 5,142,869 | 9/1992 | Iizuka et al. . | |
| 5,146,749 | 9/1992 | Wood et al. . | |
| 5,146,750 | 9/1992 | Moscrip . | |
| 5,149,247 | 9/1992 | Gros et al. . | |
| 5,159,902 | 11/1992 | Grimm . | |
| 5,177,967 | 1/1993 | von Kaler et al. . | |
| 5,177,968 | 1/1993 | Fellows . | |
| 5,181,381 | 1/1993 | Gounder . | |
| 5,195,320 | 3/1993 | Kushnir . | |
| 5,195,321 | 3/1993 | Howard . | |
| 5,199,264 | 4/1993 | Viscovich . | |
| 5,199,391 | 4/1993 | Kovalenko . | |

(List continued on next page.)

*Primary Examiner*—Noah P. Kamen
*Attorney, Agent, or Firm*—Dority & Manning, P.A.

[57] ABSTRACT

The fluid expander includes a housing, a drive shaft mounted for rotation within the housing, a piston-cylinder assembly including a cylinder and a piston disposed within the cylinder for converting energy from a working fluid to rotational energy output via a drive shaft. Various adjustment assemblies are provided for adjusting speed, torque, stroke length, and thermodynamic cycles of the device. The fluid expander assembly can be used with external combustion systems, with solar or geothermal energy systems, or with internal combustion systems.

30 Claims, 24 Drawing Sheets

U.S. PATENT DOCUMENTS 5,209,065 5/1993 Sakata .
5,209,190 5/1993 Paul .
5,211,017 5/1993 Pusic .
5,215,045 6/1993 Vadnjal .
5,228,293 7/1993 Vitale .
5,233,966 8/1993 Berg .
5,251,594 10/1993 Meyer .
5,253,473 10/1993 Duva .
5,261,365 11/1993 Edwards .
5,269,193 12/1993 Rabinow .
5,273,012 12/1993 Brock .
5,285,633 2/1994 Duva .
5,293,748 3/1994 Flanigan .
5,309,492 5/1994 Adams .
5,309,715 5/1994 Kinnersly .
5,309,716 5/1994 Kolbinger .
5,317,874 6/1994 Penswick et al. .
5,321,946 6/1994 Abdelmalek .
5,323,738 6/1994 Morse .

FLUID EXPANDER

BACKGROUND OF THE INVENTION

The present invention relates to a fluid expander and, in particular, to a rotary fluid expander having an adjustable configuration.

Internal combustion engines are commonly used in various applications to generate electrical or mechanical power. For example, internal combustion engines have been used in automobiles and other vehicles, electrical generators, lawn mowers, pumps, etc. While suitable for their conventional uses, internal combustion engines produce objectionable exhaust gases, even when expensive pollution control devices are utilized, require periodic servicing to prevent build-up of deposits caused by the combustion of fuel, require heavy engine blocks in order to contain the explosion of fuel and safely convert its force into useful mechanical motion, and may, due to the sequential firing of individual cylinders, require the use of a heavy flywheel to provide a smooth flow of power.

As an alternative to internal combustion engines, gas turbines are employed in various applications. For example, gas turbines are used to generate electrical power, and they have also been used to power vehicles and airplanes. Gas turbines have not been commonly used for vehicular and stationary applications because the extremely high rotor speeds used to achieve efficiency lead to a potential safety hazard in case of rotor failure. High speeds also require extensive gear reductions to reduce turbine output speeds to usable speeds.

Most internal combustion engines and gas turbines are powered by fossil fuels. Because the world's supply of fossil fuels is finite, alternatives such as systems that generate power from solar radiation and geothermal energy have been investigated. These systems develop energy, for example, by transferring heat energy to a working fluid, pressurizing the fluid based on the transferred heat energy, and obtaining work from the pressurized fluid via a fluid expander. However, solar and geothermal systems typically generate working fluid pressures too low to efficiently power conventional fluid expanders, thereby limiting usefulness of solar and geothermal energy sources.

Fluid expanders have been proposed in which pistons are reciprocated in cylinders while rotating around a drive shaft to power the drive shaft. Fluid expanders may utilize external combustion, useful for solar or geothermal systems, or internal combustion, useful for gasoline or diesel systems. U.S. Pat. Nos. 839,300; 980,481; 1,345,808; 3,654,906; 3,695,237; 3,939,809; 3,968,776; 4,779,579; 5,070,825; 5,094,195; 5,253,473; and 5,285,633 disclose various rotary fluid expander designs, both external and internal combustion. A drawback of these devices is that the performance characteristics of the devices are limited by the fixed nature of the structure of the devices. For example, in order to obtain a full range of torque and speed from these devices, a gearing reduction system such as a transmission is required, which can be complicated and costly.

OBJECTS AND SUMMARY OF THE INVENTION

It is a principal object of the present invention to provide an improved fluid expander which can be readily adapted to various applications.

Another object of the present invention is to provide a fluid expander which is mechanically simple, and relatively inexpensive to manufacture, without the need for foundry cast work.

Still another object of the present invention is to provide a fluid expander which can operate according to various pressure-volume cycles employing a variety of working fluids.

Another object of the present invention is to provide a self-contained fluid expander.

Still another object of the present invention is to provide a fluid expander which is adjustable to provide varying levels of power and torque, and that is capable of operating in either a forward or reverse direction, without using a transmission, due to high start up torque.

Another object of the present invention is to provide a fluid expander including piston-cylinder assemblies having a variable piston stroke from as large as greater than the cylinder's bore to as little as zero.

A further object of the invention is to provide a fluid expander having a smooth, continuous flow of power output.

Yet another object of the present invention is to provide a fluid expander suitable for use with either internal or external combustion systems.

Another object of the present invention is to provide a fluid expander that can efficiently convert geothermal or solar energy into rotational energy.

Yet another object of the present invention is to provide an adjustable expander that allows the output speed, torque, and power to be altered with little or no throttle change.

Still another object of the present invention is to provide an expander that could be used as a ground power unit in a solar or geothermal system without cold spotting the system during peak load conditions.

A further object of the present invention is to provide an expander with a variable stroke length and a variable piston head cylinder clearance so that the amount of fuel or energy used to power the expander can be minimized.

To achieve these objects and, in accordance with the purpose of the invention, as embodied and broadly described herein, a fluid expander assembly is provided comprising a housing and a drive shaft mounted for rotation within the housing and having a longitudinal axis. A first member is mounted for rotation with the drive shaft about the longitudinal axis, and a second member mounted for rotation with the drive shaft about an axis adjustably skewed from an orientation parallel to the longitudinal axis of the drive shaft. A piston-cylinder assembly includes a cylinder secured to the first member and a piston secured to the second member and disposed within the cylinder. A pressurized fluid source provides pressurized fluid to the cylinder to rotate the drive shaft via the first and second members.

In accordance with another aspect of the invention, a fluid expander assembly is provided comprising a housing and a drive shaft mounted for rotation within the housing and having a longitudinal axis. A piston-cylinder assembly is mounted for rotation with the drive shaft and having a longitudinal axis. The piston-cylinder assembly includes a piston and a cylinder for converting energy from a working fluid to rotational energy output via the drive shaft. An adjustment assembly varies an orientation of the longitudinal axis of the piston-cylinder assembly relative to the longitudinal axis of the drive shaft.

In accordance with another aspect of the invention, a fluid expander assembly is provided comprising a housing and a drive shaft mounted for rotation within the housing. A piston-cylinder assembly is mounted for rotation with the drive shaft. The piston-cylinder assembly includes a piston and a cylinder for converting energy from a working fluid to rotational energy output via the drive shaft. An adjustment assembly varies a length of stroke of the piston within the cylinder.

In accordance with another aspect of the invention, a fluid expander assembly comprises a housing and a drive shaft mounted for rotation within the housing. A piston-cylinder assembly is mounted for rotation with the drive shaft. The piston-cylinder assembly includes a piston and a cylinder for converting energy from a working fluid to rotational energy output via the drive shaft. An adjustment assembly varies a circumferential position relative to the longitudinal axis of the drive shaft at which the working fluid is supplied to the piston-cylinder assembly and varies a circumferential position relative to the longitudinal axis of the drive shaft at which the working fluid is exhausted from the piston-cylinder assembly.

In accordance with another aspect of the present invention, a fluid expander assembly comprises a housing and a drive shaft mounted for rotation within the housing. A piston-cylinder assembly is mounted for rotation with the drive shaft. The piston-cylinder assembly includes a piston and a cylinder for converting energy from a working fluid to rotational energy output via the drive shaft. An adjustment assembly varies a circumferential length relative to the longitudinal axis of the drive shaft at which the working fluid is supplied to the piston-cylinder assembly, and varies a circumferential length relative to the longitudinal axis of the drive shaft at which the working fluid is exhausted from the piston-cylinder assembly.

The accompanying drawings, which are incorporated in and constitute a part of this specification, illustrate one presently preferred embodiment of the invention and, together with the description, serve to explain the principles of the invention.

DETAILED DESCRIPTION OF THE PREFERRED EMBODIMENTS

Figure 1:
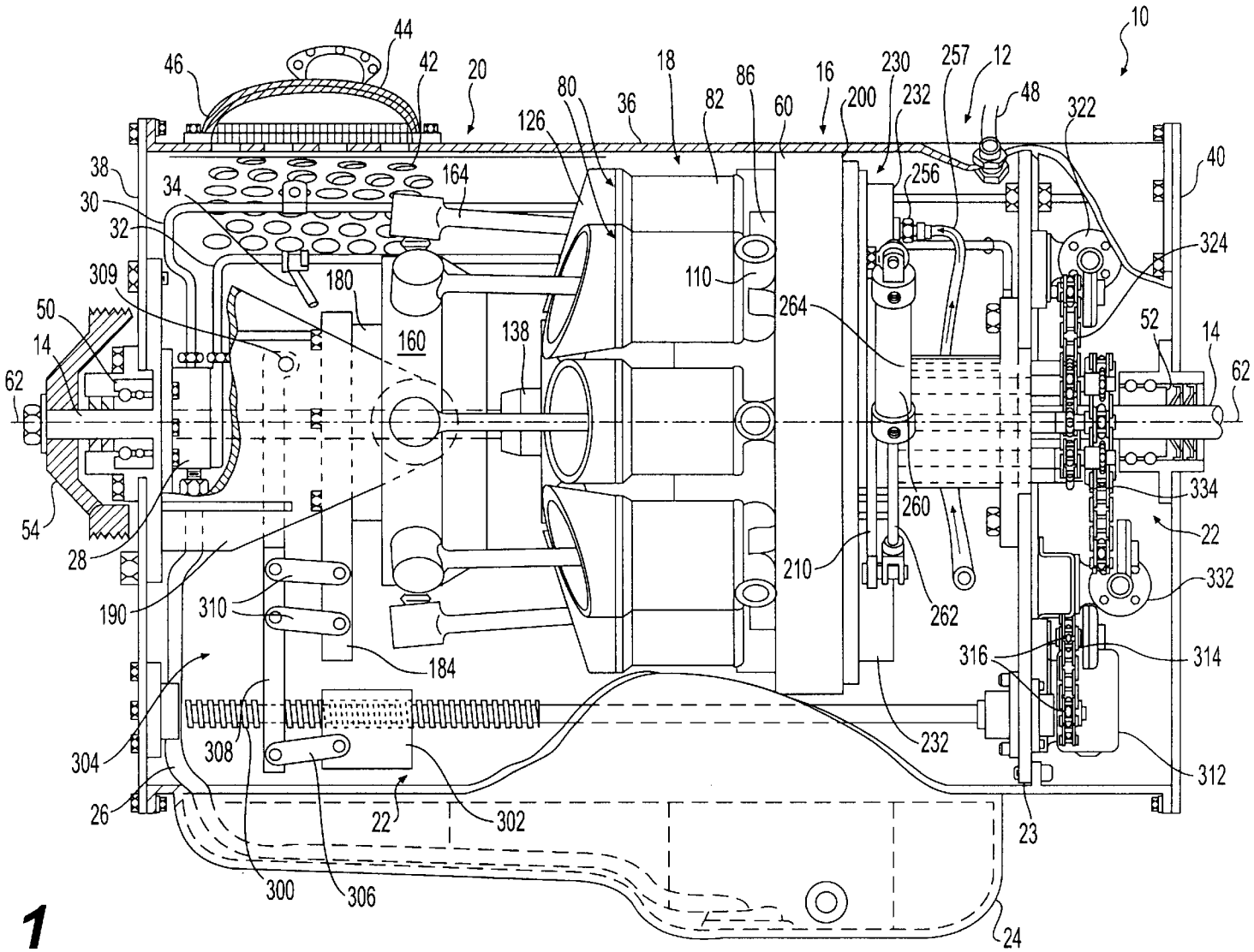
FIG. 1 is a partial sectional, side view of a preferred embodiment of the present invention.

Reference will now be made in detail to the presently preferred embodiments of the invention, one or more examples of which are illustrated in the accompanying drawings. Each example is provided by way of explanation of the invention, and not limitation of the invention. In fact, it will be apparent to those skilled in the art that various modifications and variations can be made to the examples described herein without departing from the scope or spirit of the invention. For example, features illustrated or described as part of one embodiment can be used on another embodiment to yield a still further embodiment. Thus, it is intended that the present invention includes such modifications and variations as being within the scope of the appended claims and their equivalents. The numbering of the components in the drawings is consistent throughout the application, with the same or like components having the same or like numbers in each of the drawings.

A preferred embodiment of a fluid expander assembly according to the present invention is depicted generally in FIG. 1. The fluid expander assembly 10 includes a housing 12 and a drive shaft 14 protruding out of and rotatable relative to the housing. The remainder of the fluid expander assembly 10 can be subdivided into the following subassemblies: a fluid distribution assembly 16, a cylinder mount assembly 18, a piston mount assembly 20, and an adjustment assembly 22.

Fluid distribution assembly 16 is adjustably mounted to housing 12. Cylinder mount assembly 18 and piston mount assembly 20 rotate with shaft 14 and relative to fluid distribution assembly 16. Adjustment assembly 22 adjusts the orientation of various parts within assemblies 16–20 in order to achieve various desired output characteristics. The structure and operation of each of these subassemblies will be described in detail below.

As shown in FIG. 1, housing 12 surrounds fluid distribution assembly 16, cylinder mount assembly 18, piston mount assembly 20, and adjustment assembly 22. Housing 12 includes an oil pan 24 for collecting lubricant from the inside of housing 12. The lubricant, preferably environmentally friendly motor oil, travels through conduit 26 via the efforts of a two-in-one lubrication oil and hydraulic system pump 28. Pump 28 dispenses lubricant at a high pressure to the hydraulic adjustment motors and pistons used by the expander 10, as will be described below. Pump 28 dispenses lubricant at a low pressure to conduit 32, which lubricates the moving parts of the expander 10. For example, conduit 32 communicates with a spray outlet 34 that lubricates the piston mount assembly 20 and also lubricates adjustment assembly 22 and fluid distribution assembly 16 via a conduit (not shown) providing lubricant to the support shaft 150. Pump 28 is powered by output of drive shaft 14.

A wall 23 within housing 12 provides a lubricant barrier. As shown in FIG. 1, the portion 12*a* of the housing 12 to the left of wall 23 is sprayed with lubricant which collects in oil pan 24. The portion 12*b* of housing 12 to the right of wall 23 is not sprayed with lubricant so as to prevent interference with the electric or hydraulic motors mounted therein, which will be discussed below.

Housing 12 also includes a side wall 36 and end walls 38 and 40. As shown in FIG. 1, housing 12 is substantially cylindrical, however any shape of housing is acceptable within the scope of the invention. A cylindrical housing 12 is preferred in that it minimizes the size of the housing and allows for effective cycling of lubricant.

Figure 17:
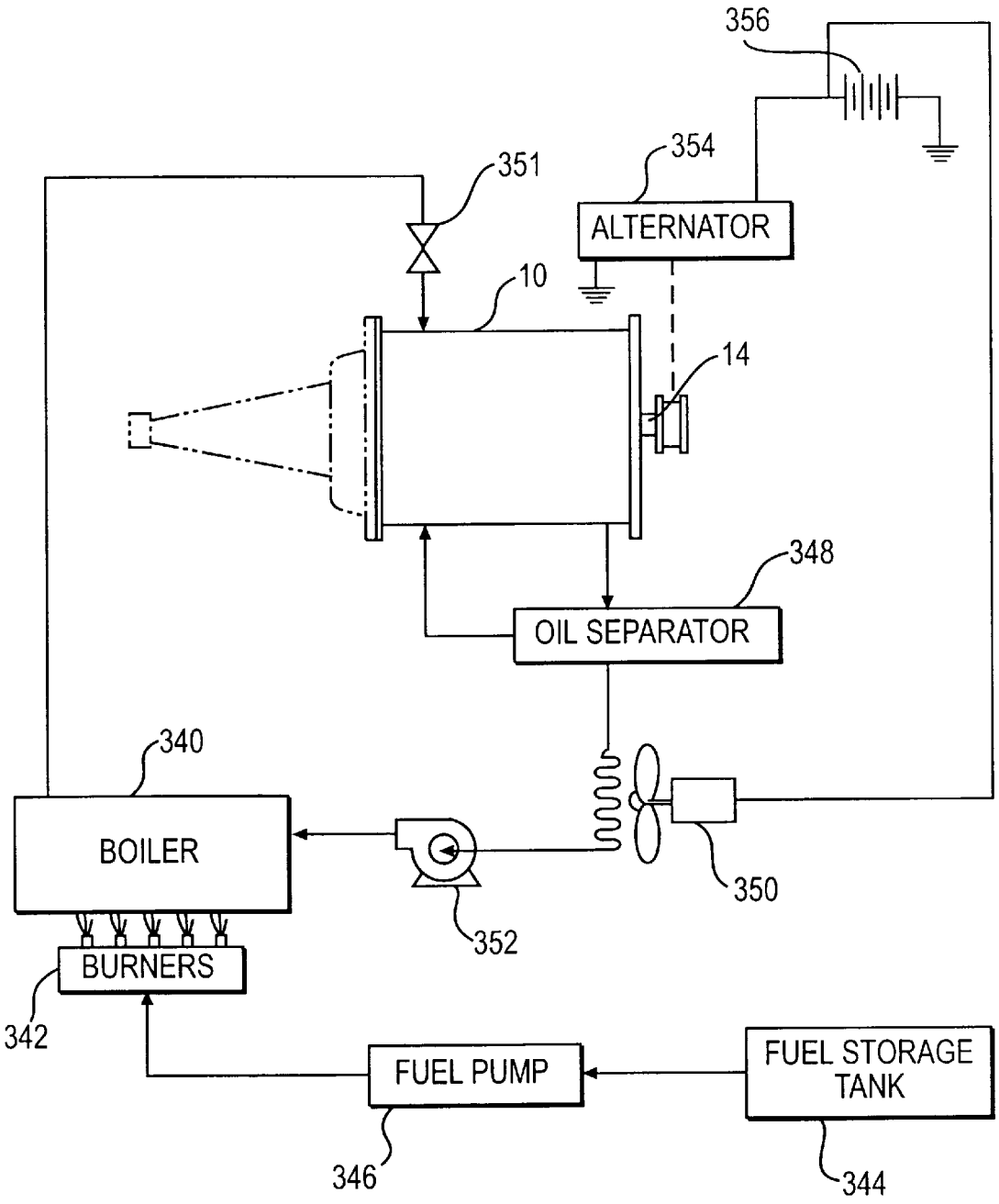
FIG. 17 is a diagram showing one possible external combustion system in which the present invention could be used.
Figure 18:
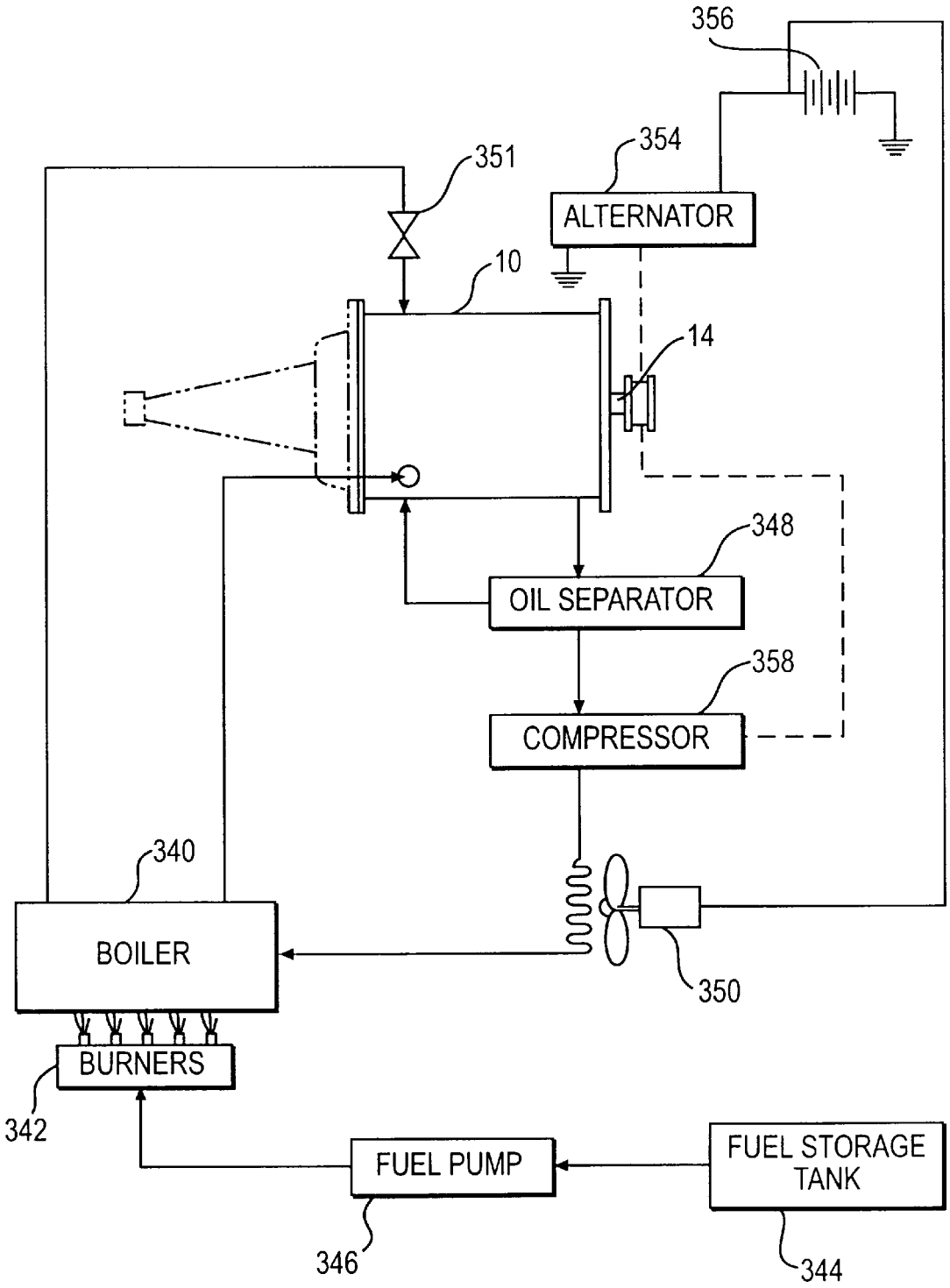
FIG. 18 is a diagram showing a second possible external combustion system in which the invention could be used.
Figure 19:
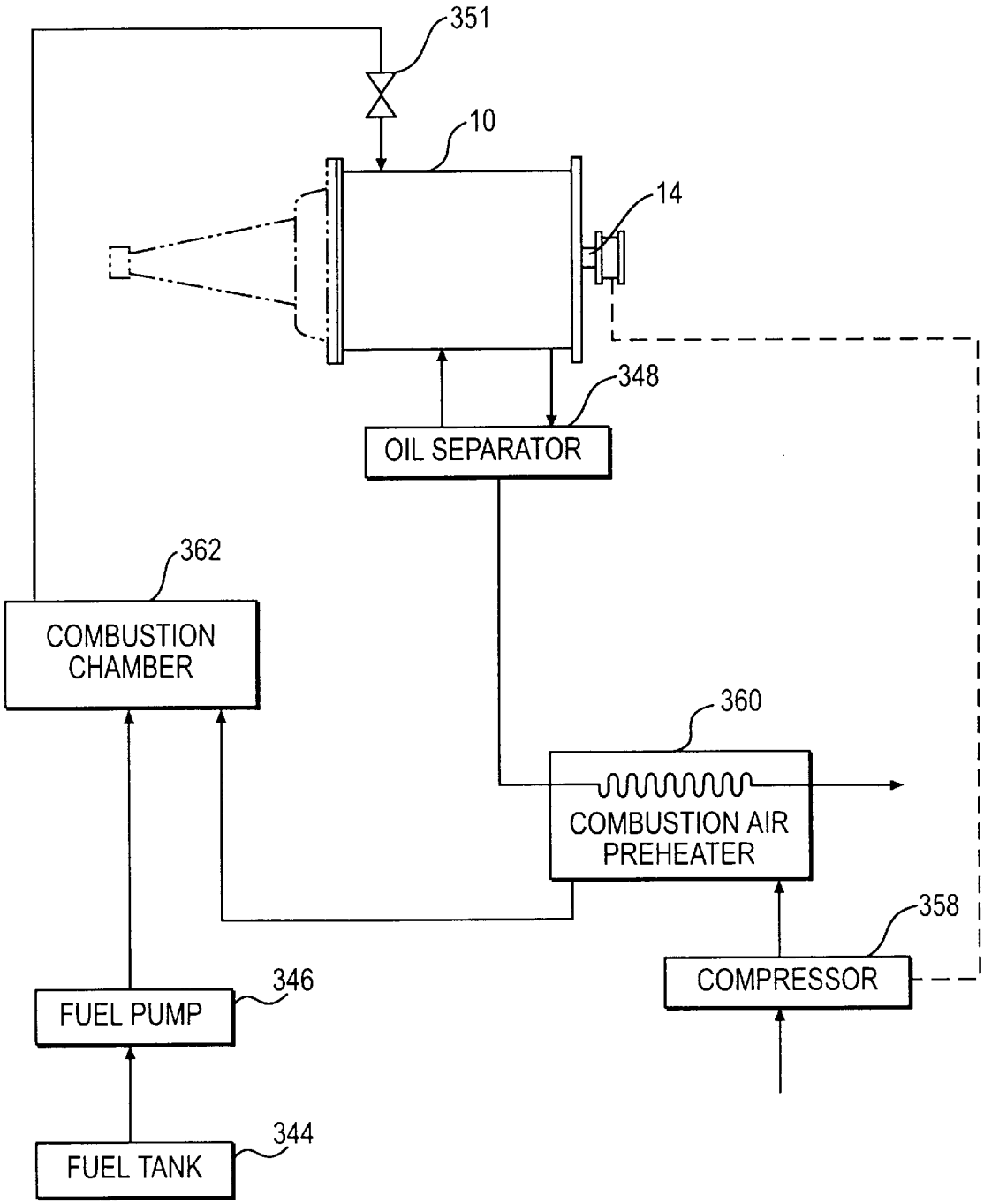
FIG. 19 is a diagram showing a third possible external combustion system in which the present invention could be used.

Holes 42 are defined through side wall 36 in communication with an outlet fixture 44 for withdrawing used working fluid from housing 12. Preferably, a filter 46 is disposed within outlet fixture 44 for preventing flow of lubricant into the working fluid system, and a fluid separation well (not shown) is provided to return filtered lubricant to housing 12. As will be described in greater detail below, working fluid is supplied to fluid distribution assembly 16 via conduit 48. As shown in FIGS. 17–19, fluid expander assembly 10 may be used within a system which otherwise extends between outlet fixture 44 and input conduit 48.

Drive shaft 14 is mounted through end walls 38 and 40 on bearing assemblies 50 and 52, respectively. Either end of drive shaft 14, or both ends, may be used as the drive shaft output. As shown in FIG. 1, an output drive pulley 54 is mounted to one end of drive shaft 14. However, such a drive pulley, or any other suitable device, may be employed at either or both ends of the drive shaft. For example, drive shaft 14 may be linked to a constant-velocity universal joint (not shown) to transmit rotational output.

Figure 2A:
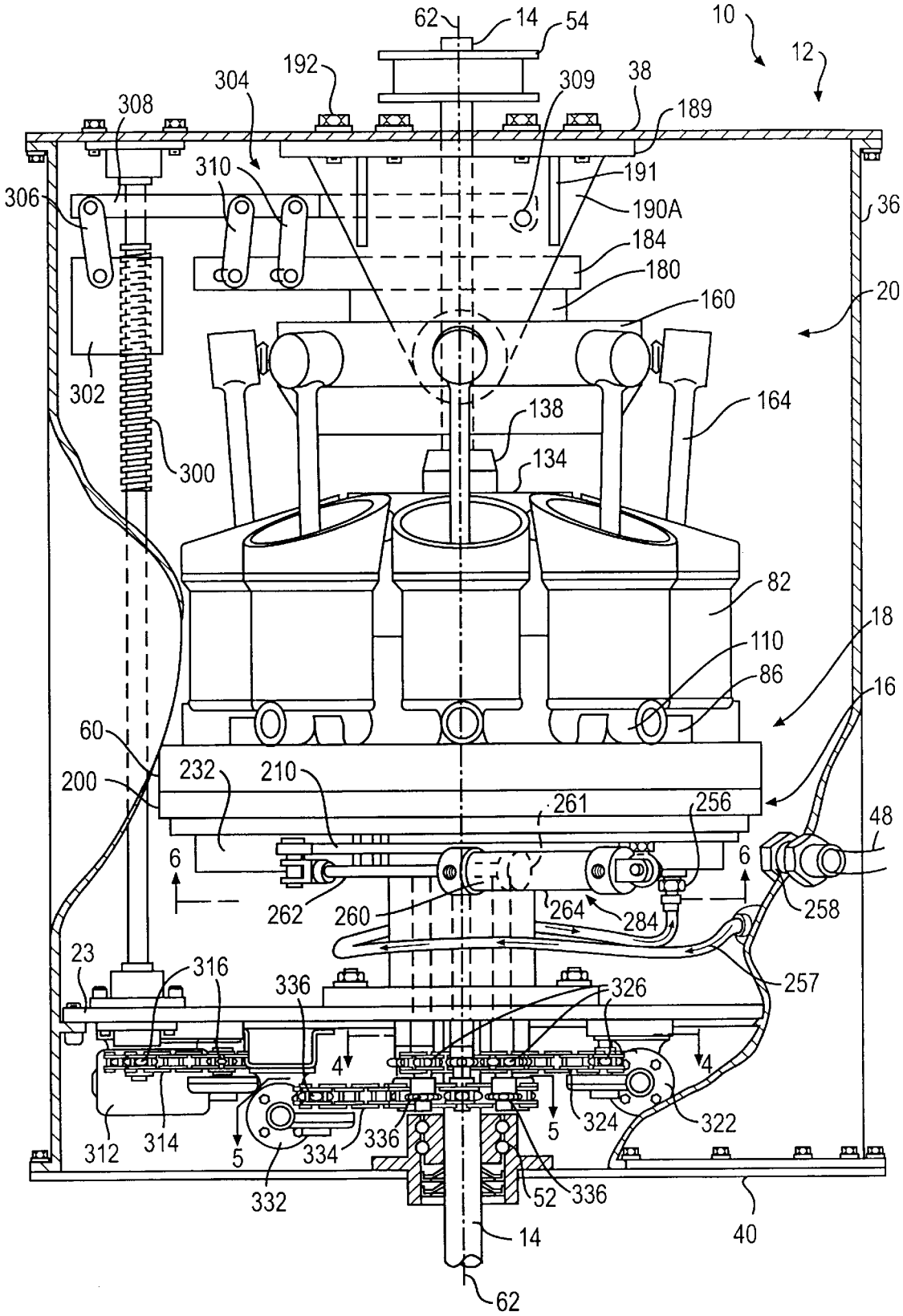
FIG. 2A is an enlarged partial sectional, side view of the device of FIG. 1.

As shown in FIG. 2A, housing 12 may alternately be oriented so that drive shaft 14 extends vertically, rather than horizontally as in FIG. 1. If so, the oil pan 24 and associated conduits 26, 30, 32 and other related lubrication system features can be redesigned or eliminated in favor of an external lubricant reservoir. Therefore, fluid expander assembly 10 may be operated in any orientation as long as the lubrication system is correspondingly designed and located within housing 12.

Cylinder mount assembly 18 includes a first member such as a collector plate 60 mounted for rotation about longitudinal axis 62 of drive shaft 14. As shown in FIGS. 3C and 3D, collector plate 60 is an essentially annular plate. An adaptor 64 may be secured to an inner portion of collector plate 60 to join collector plate 60 to thrust bearing 66. A second adaptor 68 is attached to an inner portion of bearing 66. An inner portion of adaptor 68 includes inclined splines 70 which mate with inclined splines 72 formed on an outer surface of gear 74. An annular shaft 150 is disposed about drive shaft 14 and is fixed to housing 12 so that drive shaft 14 may rotate within support shaft 150. Support shaft 150 includes straight splines 76 extending parallel to longitudinal axis 62, and meshes with similar straight splines (not shown) on an inner portion of gear 74.

Thus, sliding movement of gear 74 along support shaft 150 causes adaptor 68 to rotate around support shaft 150, and thus around drive shaft 14, due to the interaction of inclined splines 70 and 72. Further, collector plate 60 and adaptor 64 will also rotate about drive shaft 14 because thrust bearing 66 disposed between adaptors 64 and 68 rotationally joins gear 74 to collector plate when gear 74 slides along support shaft 150.

However, as will be described below, if gear 74 is stationary, adaptor 68 will not rotate about drive shaft 14 due to the meshing of inclined splines 70 and 72. Adaptor 64 and collector plate 60 may then rotate with drive shaft 14 around bearing 66 due to their interconnection with drive shaft 14 via hub 136, as will be described below.

Preferably, the inclined splines 70, 72 are cut at such an angle that the sliding of gear 74 along support shaft 150 rotates collector plate 60 about support shaft 150 enough to allow cylinders 82 to incline fully in either direction, as will be described below. (To incline cylinders 82 fully from an upright position parallel to axis 62 to an inclined position should not require more than about 45° of rotation. Thus, from one end of its sliding travel along support shaft 150 to the other, gear 74 should, due to splines 70, 72 and thrust bearing 66, rotate collector plate 60 about 9°. Gear 74 is shown in a neutral position in FIG. 3D, with cylinder 82 parallel to axis 62, rather than inclined to it.

The inclined splines 70, 72 also absorb and dampen vibration of collector plate 60 during operation of the device and provide support in the direction of axis 62 for all of the parts rotating around thrust bearing 66.

Figure 15A:
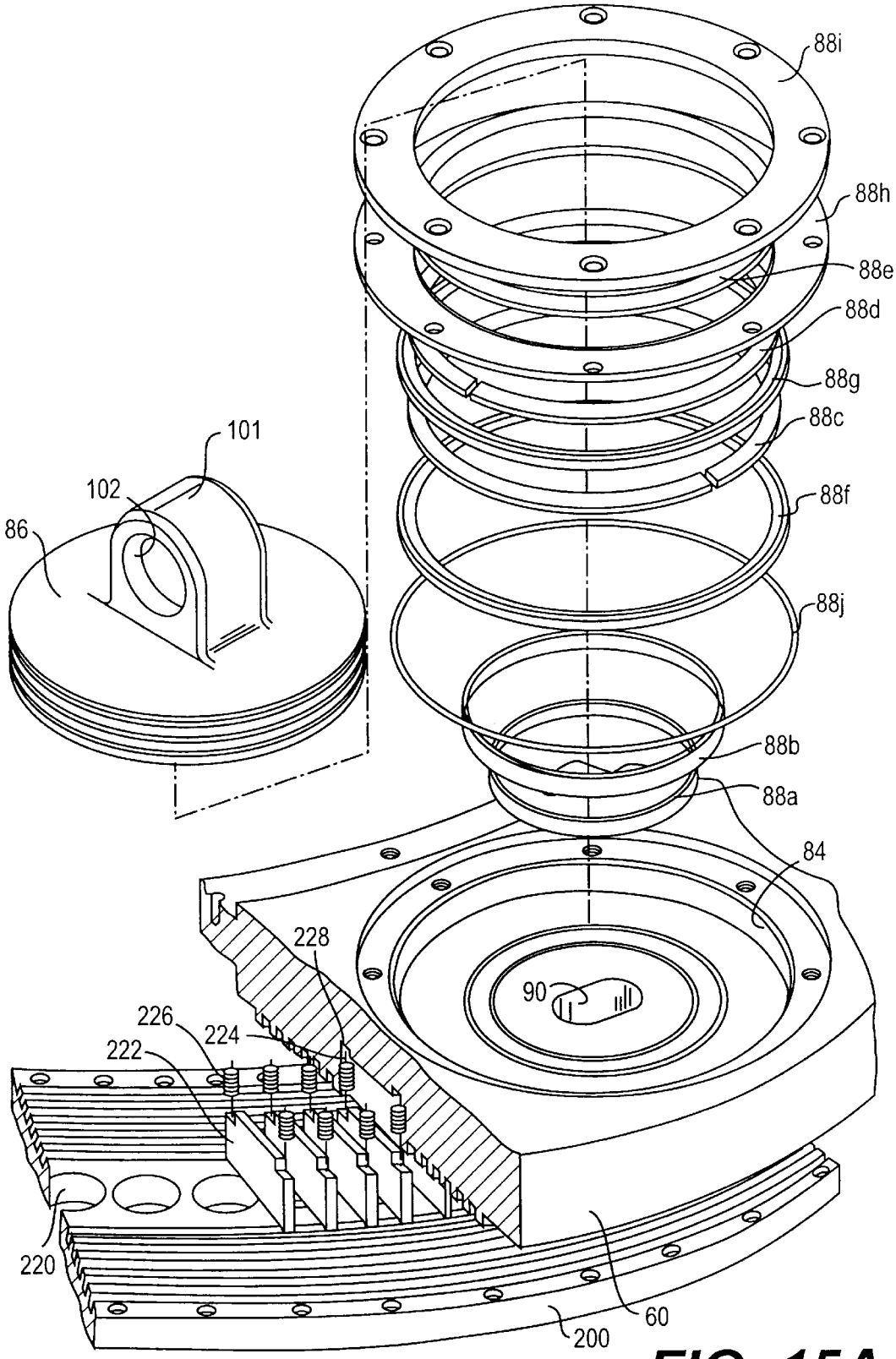
FIG. 15A is a partial sectional, assembly drawing showing attachment of a journal boss to the distributor plate.
Figure 15B:
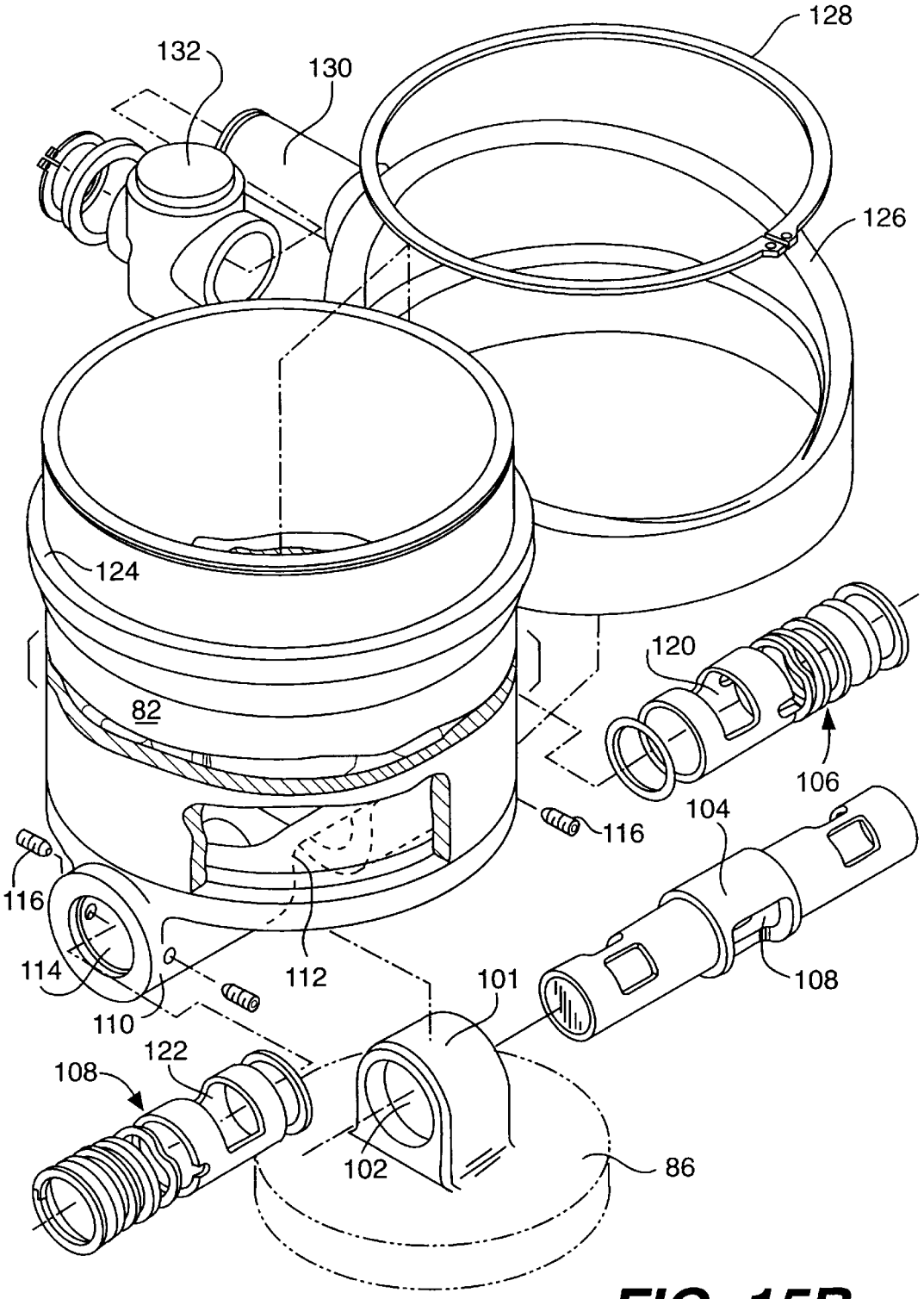
FIG. 15B is an assembly drawing showing attachment of a cylinder to the journal boss.

As shown in FIGS. 3C and 3D, and as shown in disassembled form in FIGS. 15A and 15B, cylinder mount assembly 18 includes at least one piston-cylinder assembly 80 including a cylinder 82 secured to collector plate 60. In the presently disclosed embodiment, eight piston-cylinder assemblies 80 are provided including eight cylinders 82.

As shown in FIGS. 15A and 15B, each cylinder 82 is secured within a bore 84 in a surface of collector plate 60 by a journal boss 86. Sealing rings 88*a–j* are provided between journal boss 86 and bore 84 to provide a fluid-tight seal. An opening 90 extends through collector plate 60 at the base of bore 84. As shown in FIG. 3D, opening 90 communicates with opening 92 in journal boss 86 to allow working fluid to flow there through as will be described below. Journal boss 86 and sealing rings 88*a–j* may be secured to collector plate 60 by screws 94, or by bolts or any other suitable means.

As shown in FIG. 15B, a wrist pin assembly 100 is inserted through a hole 102 extending through an upper extending portion 101 of journal boss 86. As shown in FIG. 15, for ease of assembly, wrist pin assembly 100 may include three parts 104, 106, and 108. Part 104 is an essentially tubular member that fits within hole 102 in journal boss 86 and within a connecting portion 110 of cylinder 82. Wrist pin assembly parts 106 and 108 include a number of sealing members which fit over the end of part 104 and within portion 110. Connecting portion 110 includes slot 112 for receiving extending portion 101 of journal boss 86, and also includes an opening 114 extending along the length of the connecting portion 110 for receiving parts 104, 106, and 108.

In order to assemble cylinder 82 and journal boss 86, connecting portion 110 is placed over journal boss 86 so that extending part 101 fits within slot 112. Wrist pin assembly part 104 is then slid into opening 112. Wrist pin assembly parts 106 and 108 are then slid into either end of opening 114, and are secured in place by set screws 116. Holes 118 and 120 in wrist pin assembly part 104, and hole 122 in wrist pin assembly parts 104 and 106, place opening 92 in communication with the interior of cylinder 82, as shown in FIG. 3D.

Once assembled to journal boss 86, cylinder 82 can pivot around an axis 115 extending longitudinally along connecting portion 110 and wrist pin assembly part 104 relative to journal boss 86. Journal boss 86 is rotatably mounted within bore 84 of collector plate 60, thereby allowing cylinder 86 to rotate around an axis 117 extending through the center of bore 84. The combination of the rotatable mount of journal boss 86 within collector plate 60 and the pivotable mount of cylinder 82 to journal boss 86 allows cylinder 82 to move freely relative to collector plate 60.

As shown in FIG. 15B, cylinder 82 includes a ridge 124 extending around a top portion of its outer surface. A cuff 126 is seated about the cylinder 82 on ridge 124. Cuff 126 is rotatably secured to cylinder 82 by a snap ring 128. A pin 130 extends from cuff 126 and is rotatably secured within a control boss 132. A power transfer flange 134 and a hub 136 are attached together by bolts 137 securing control boss 132 therebetween. Power transfer flange 134 is secured, for example, by welding to a collar 138. Drive shaft 14 and collar 138 include straight splines 140, 142 that mesh with each other.

Hub 136 is mounted on a bearing 144, which is in turn mounted via a plate 146 to a threaded cylinder 148. Straight splines 150, 152 on support shaft 150 and threaded cylinder 148, respectively, mesh to prevent threaded cylinder 148 from rotating relative to support shaft 150, but allow threaded cylinder 148 to slide along support shaft 150.

Bearing 144 allows hub 136, control boss 132, power transfer flange 134, and collar 138 to rotate with drive shaft 14 as a unit relative to threaded cylinder 148 and support shaft 150. Collector plate 60 is connected to collar 138 via journal boss 86, wrist pin assembly 100, cylinder 82, cuff 126, snap ring 128, pin 130, control boss 132, power transfer flange 134, and bolt 137, so that collector plate 60 rotates with drive shaft 14 along with all of the interconnected parts mentioned above.

Support shaft 150 is secured to housing 12 and fits about drive shaft 14 so that drive shaft 14 is freely rotatable within support shaft 150. Threaded cylinder 148 and gear 74 thus slide along support shaft 150 without rotating, thereby allowing the elements secured to the right side of bearings 144 and 66 in FIG. 3D to rotate as a unit along with drive shaft 14.

As shown in FIG. 1, piston mount assembly 20 includes a second member mounted for rotation with drive shaft 14. The second member may be a rotor hub 160 as shown in FIG. 3B. A piston 162 is disposed within each cylinder 82 so as to be slidable within the cylinder. A piston rod 164 is attached to each piston 162 via a ball joint 166 to keep the piston from rotating during operation due to the action of the rod 164. Each piston rod 164 is secured to rotor hub 160 via a ball joint 168. Rotor hub 160 is secured to a constant-velocity universal joint 170, which is in turn mounted on drive shaft 14 via intermeshing straight splines 172, 174 and held against sliding along the shaft by snap rings 175. Thus, rotor hub 160 rotates with drive shaft 14.

Rotor hub 160 is also secured to roller bearing 176 by a snap ring 178. Roller bearing 176 is secured to a retainer 180 by another snap ring 182. Bolts 185 attach retainer 180 to yoke 184, the position of which can be adjusted, as will be described below. Adjusting the position of the yoke 184 accordingly adjusts the position of the entire piston mount assembly 20, causing it to pivot around constant-velocity universal joint 170, which is held in place on drive shaft 14 by snap rings 175.

Yoke 184 and retainer 180 do not rotate with drive shaft 14, as they are secured to end wall 38 of housing 12 via plates 190A, 190B. Thus, rotor hub 160 rotates with constant-velocity universal joint 170 and within roller bearing 176, while retainer 180 and yoke 184 remain fixed against rotation.

Figure 2B:
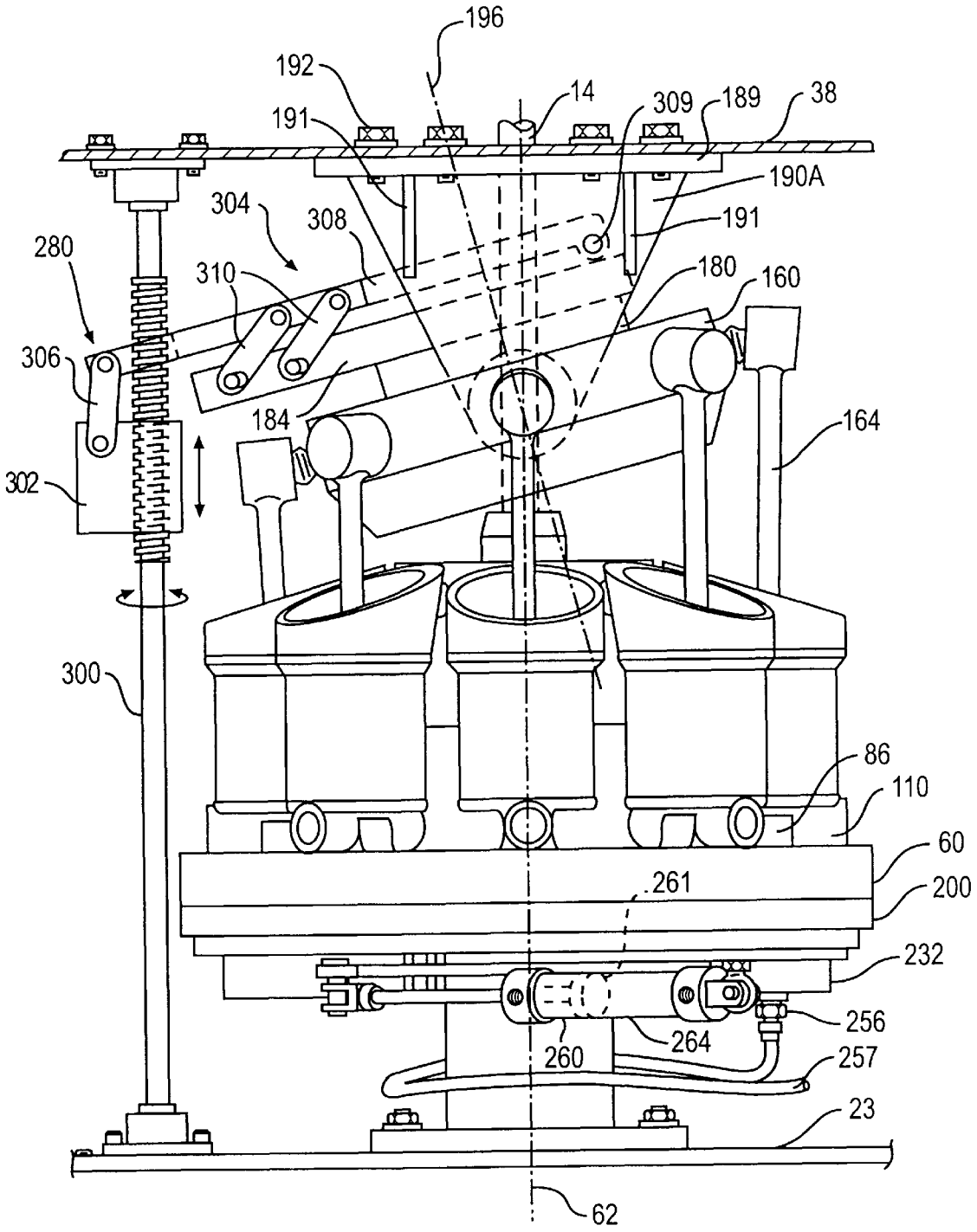
FIG. 2B is an enlarged partial side view of the device of FIG. 1 with the rotor hub in an inclined position.
Figure 3A:
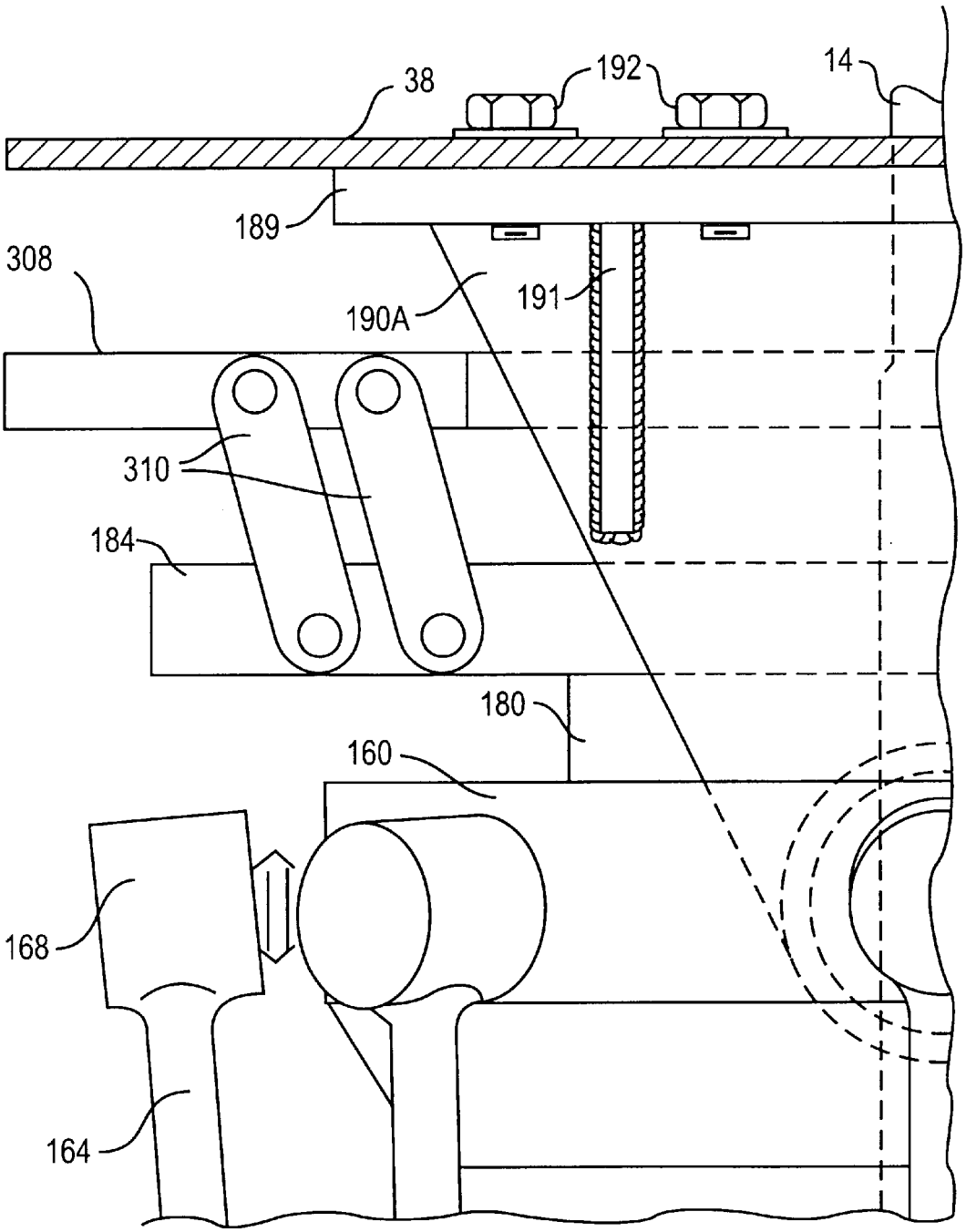
FIG. 3A is an enlarged view of a first portion of the device of FIG. 2A.
Figure 3B:
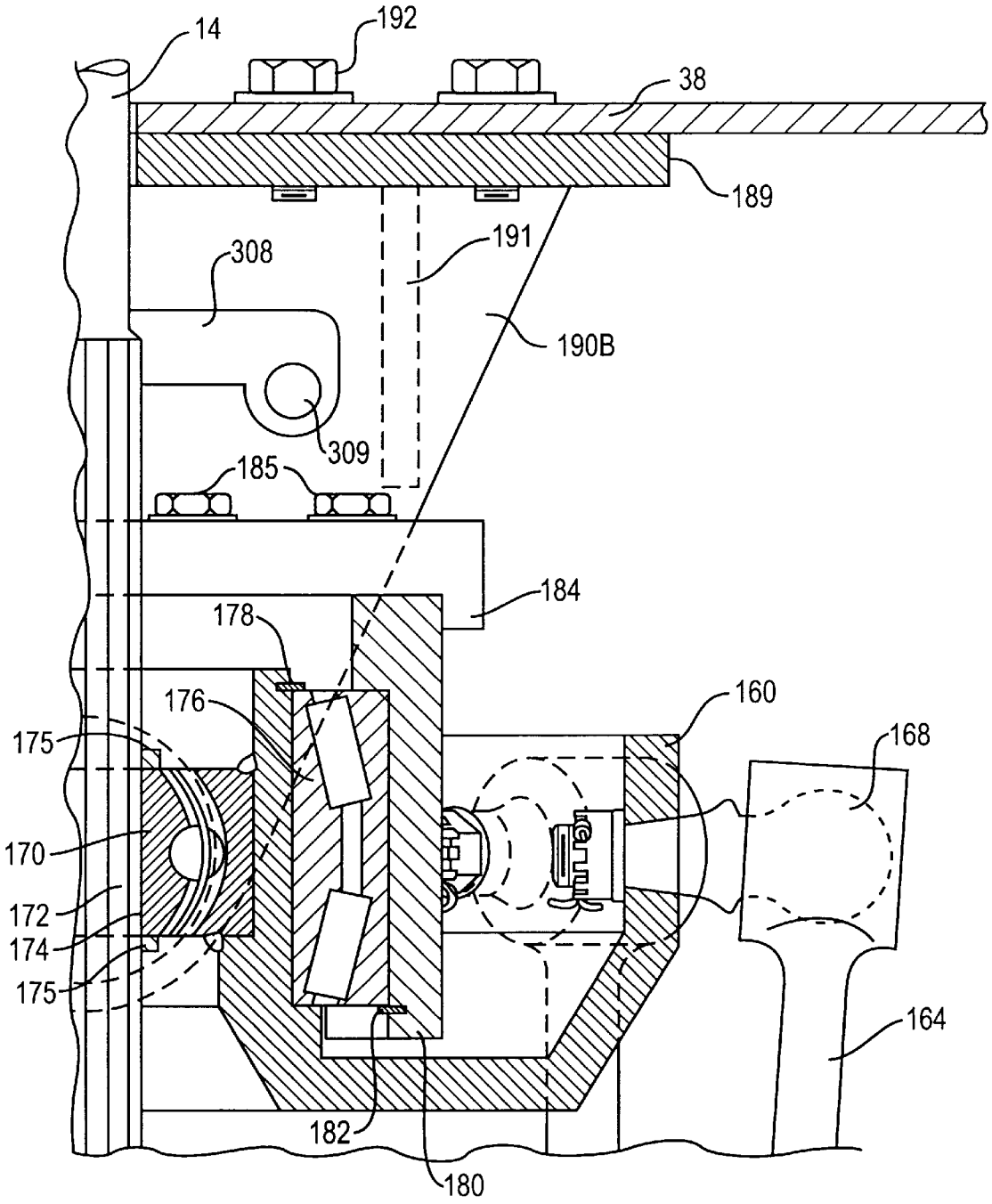
FIG. 3B is an enlarged sectional view of a second portion of the device of FIG. 2A.
Figure 3C:
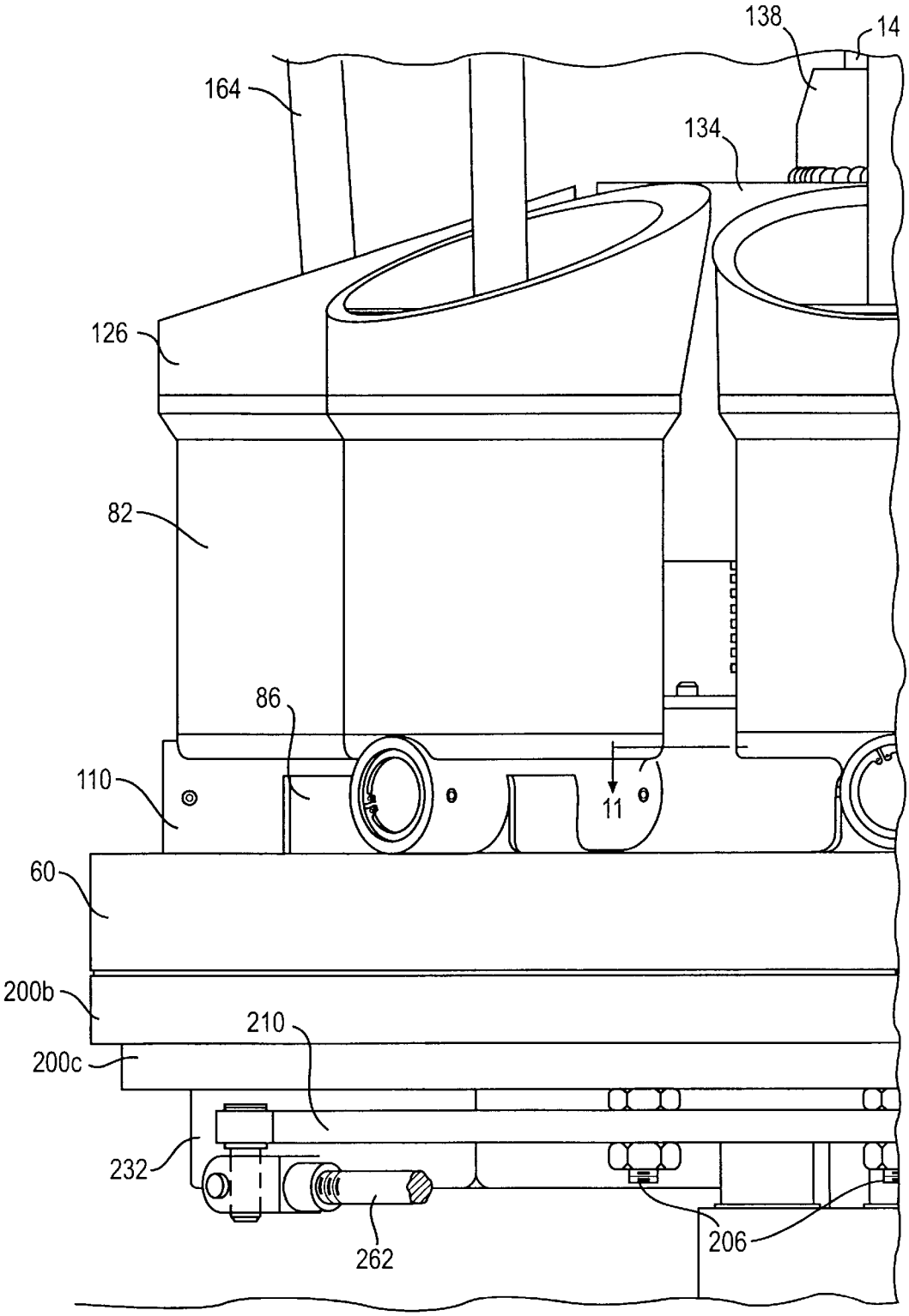
FIG. 3C is an enlarged view of a third portion of the device of FIG. 2A.
Figure 3D:
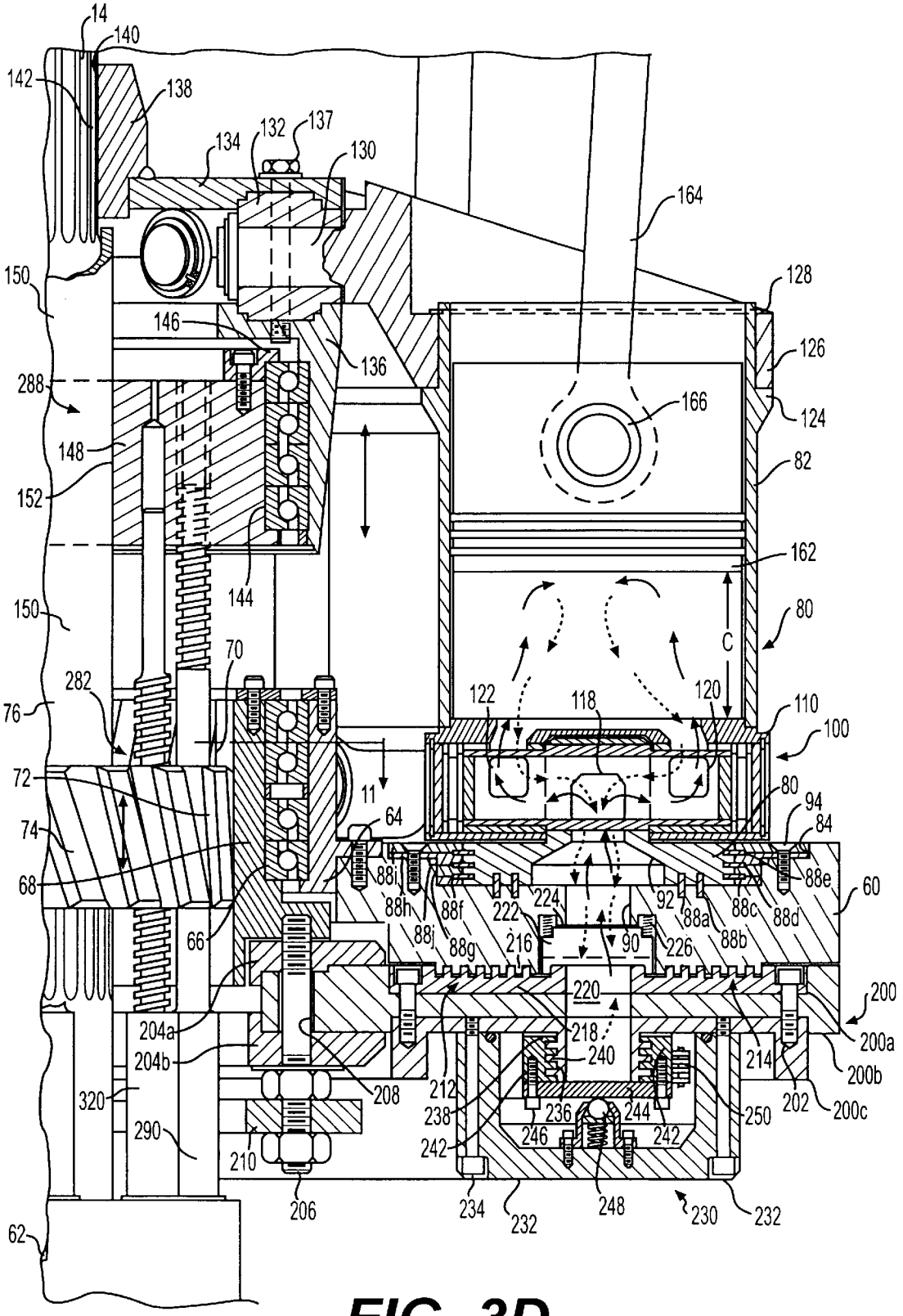
FIG. 3D is an enlarged sectional view of a fourth portion of the device of FIG. 2A.
Figure 14:
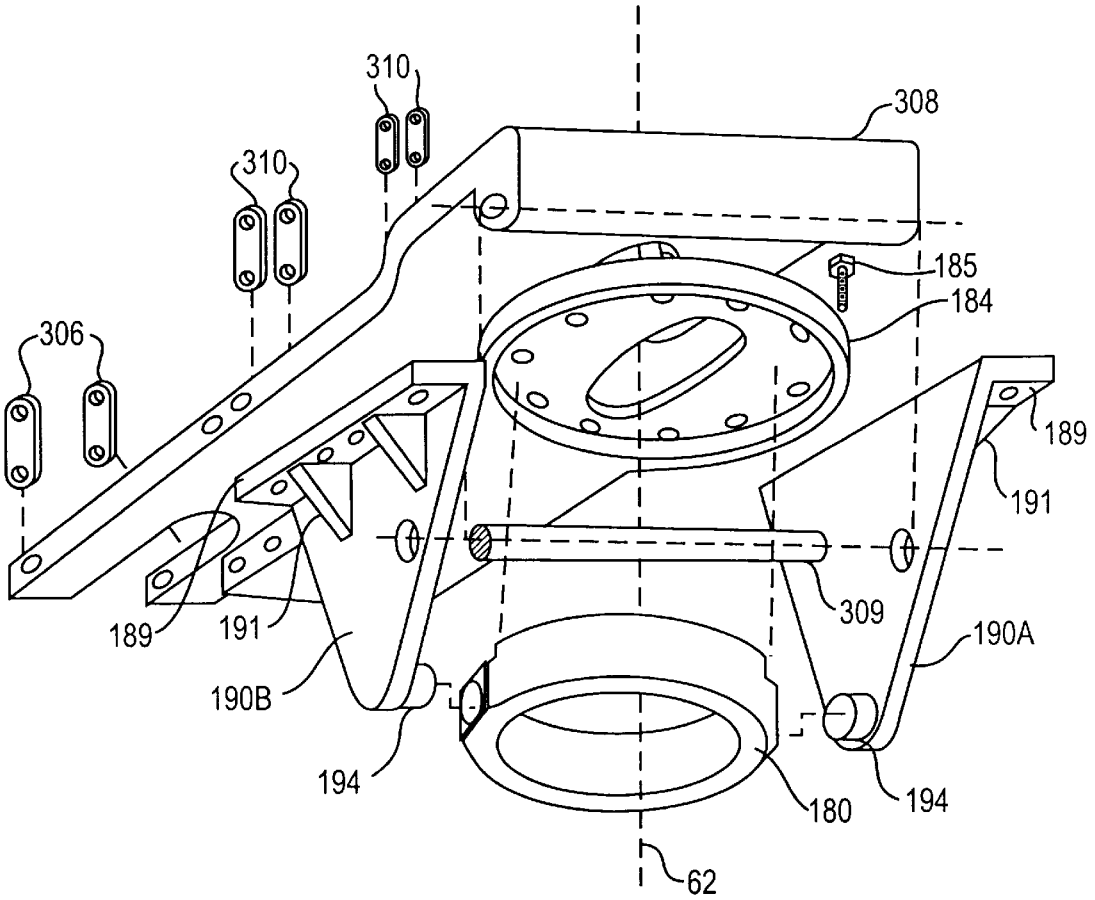
FIG. 14 is an isometric assembly drawing showing a portion of rotor hub adjustment subassembly.

The two plates 190A, 190B, one in front of drive shaft 14 in FIG. 3A and the other behind drive shaft 14 in FIG. 3B, are mounted to end wall 38 of housing 12 by bolts 192. Flanges 189 and gussets 191 help secure plates 190A, 190B to wall 38. As indicated in FIG. 3A, the lower ends of plates 190A, 190B extend into rotor hub 160 between the ball joints 168 and the retainer 180. As shown in FIG. 14, pivot pins 194 protrude from the distal end of plates 190A, 190B and extend into openings in retainer 180. Pivot pins 194 are coaxial so that retainer 180 may tilt or pivot about pivot pins 194 to thereby tilt the rest of the piston mount assembly 20 relative to longitudinal axis 62 of drive shaft 14. As shown in FIG. 2B, when tilted, rotor hub 160 is rotatable about an axis 196 skewed from an orientation parallel with longitudinal axis 62 of drive shaft 14. However, when rotor hub 160 is disposed as shown in FIGS. 3A and 3B, the longitudinal axes 62 and 196 coincide. The pivoting of retainer 180 on pins 194 about joint 170 prevents excessive vibration of drive shaft 14 and rotor hub 160 during operation. Retainer 180 should be able to pivot enough to change the stroke of pistons 162 within cylinders 82, which is a function of the size and number of cylinders as well as the diameter which the cylinders are spaced. Preferably retainer should pivot about 18°, and preferably should pivot enough to allow the piston 162 stroke to be 12.5% more than the diameter of the piston bore within cylinder 82.

Fluid distribution assembly 16 of fluid expander assembly 10 provides pressurized fluid to cylinders 82 to rotate drive shaft 14 via rotor hub 160 and collector plate 60. Fluid distribution assembly 16 includes a number of parts adjustably mounted adjacent collector plate 60.

For example, fluid distribution assembly 16 includes a distributor plate 200 including a surface opposing a bottom surface of collector plate 60 as shown in FIG. 3D. The distributor plate 200 of FIG. 3D includes three parts 200*a–c*, but the distributor plate could be made of a single part, if desired. Making the distributor plate 200 out of three parts simplifies its manufacture. If the distributor plate 200 is made of several parts, the parts can be secured together by screws 202, or by any other suitable means.

Figure 6:
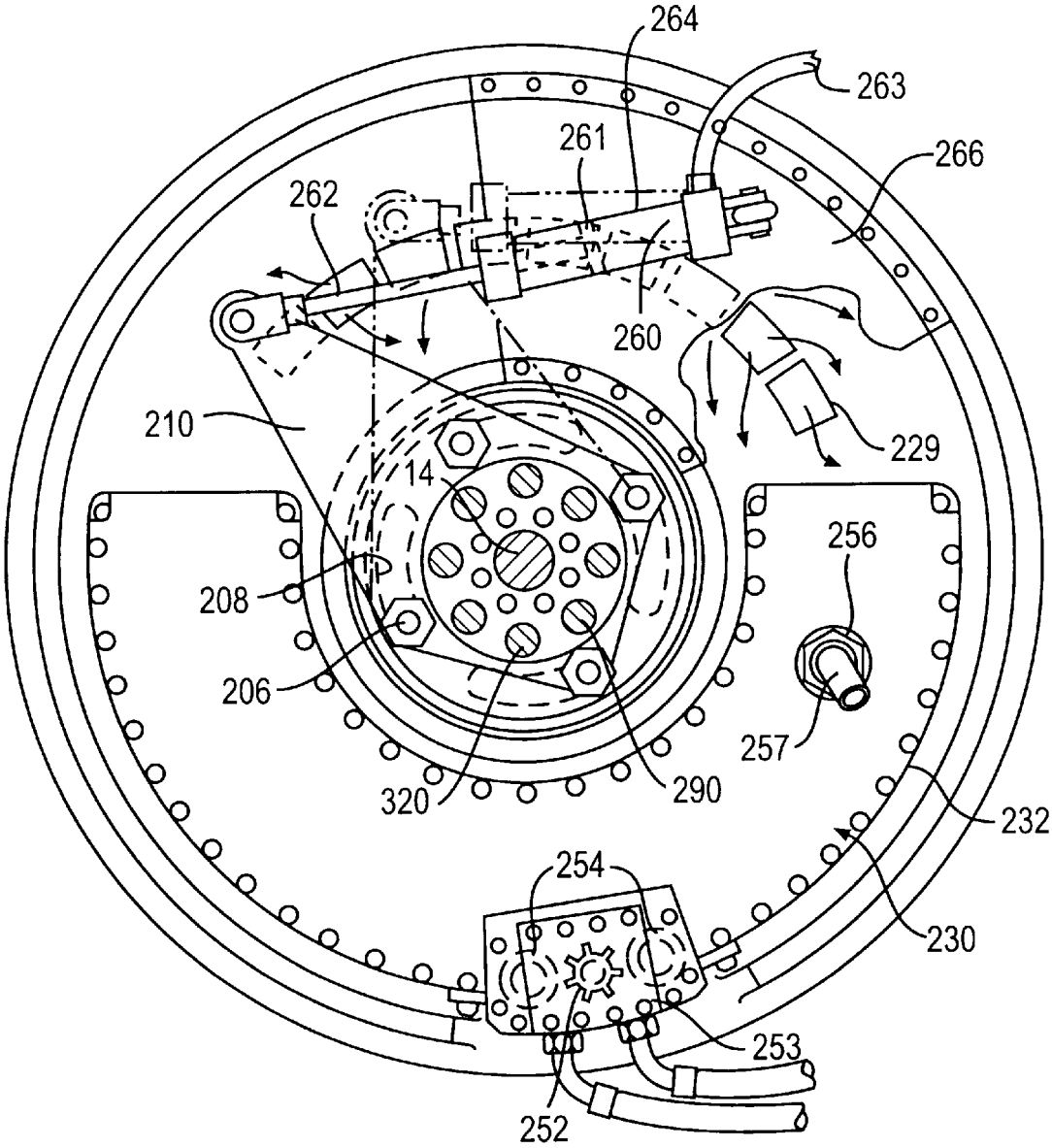
FIG. 6 is a partial sectional view of the present invention, taken along line 6—6 in FIG. 2A.

The inner radial portion of distributor plate 200 is secured between portions 204*a* and 204*b* of hub 204 which can be formed integral with or secured to adaptor 68 as shown in FIG. 3D. Hub portions 204*a* and 204*b* are secured to adaptor 68 by bolts 206. While end portions of each bolt 206 are threaded into hub portions 204*a* and 204*b*, and into adaptor 68, a middle portion of bolt 206 slides in a groove 208 formed in a radially inner portion of distributor plate 200. As shown in FIG. 6, a plurality of bolts 206 are provided and are secured at one end to a control plate 210. The operation of control plate 210 will be described below.

Two labyrinth seals 212, 214 are formed in the interface between collector plate 60 and distributor plate 200 by alternating ridges 216, 218. Openings 220 are formed through distributor plate 200 at an equal radial distance from longitudinal axis 62 as openings 90 in collector plate 60. Thus, when properly aligned, openings 220 and 90 communicate with each other. FIG. 14 shows a number of openings 220 disposed adjacent each other and extending through distributor plate 200.

A plurality of sealing vanes 222 are provided in slots 224 formed in a bottom surface of collector plate 60. Springs 226 are provided to urge sealing vanes 222 lightly against distributor plate 200. Each pair of springs 226 preferably exerts about 3 pounds of force or less to urge a sealing vane 222 against distributor plate 200. Sealing vanes 222 prevent working fluid from traveling circumferentially around collector plate 60 and distributor plate 200, and direct the fluid instead into an adjacent cylinder 82, as will be described below. As shown in FIG. 15A, several sealing vanes 222 are provided, and at least one sealing vane should be provided between adjacent openings 220 to provide a seal and ensure flow of working fluid from each opening 220 into a corresponding opening 90.

In order to maintain good sealing, preferably a clearance of 50 thousandths of an inch is provided between collector plate 60 and distributor plate 200. Using the presently disclosed manifold assembly 230 and labyrinth seals 212, 214, as well as a lubricant provided within distributor plate 200, 92 p.s.i. working fluid can be supplied to cylinders 82 from a supply of fluid at 98 p.s.i. Thus, the sealing arrangement between collector plate 60 and distributor plate 200 provides minimal leakage.

Fluid distribution assembly 16 also includes a manifold assembly 230 secured to distributor plate 200. Manifold assembly 230 includes a channel-shaped manifold 232 which may be secured to distributor plate 200 by, as shown in FIG. 3D, screws 234, or by welding, or by any other suitable method. An arcuate ridge 236 extends from the bottom portion of the distributor plate 200 within manifold 232, as shown in FIG. 3D. Openings 220 in distributor plate 200 extend through ridge 236. The sides of ridge 236 includes smaller ridges 228 that mesh with ridges 240 formed on side slider plates 242. A base slider plate 244 is attached to side slider plates 242 by screws 246, as shown in FIG. 3D, or by any other suitable means.

Once assembled, base slider plate 244 and side slider plates 242 slide as a unit around the arcuate ridge 236 extending from the distributor plate 200. Spring loaded ball bearings 248 attached to the inside of manifold 232 to support and contact base slider plate 244.

Figure 7:
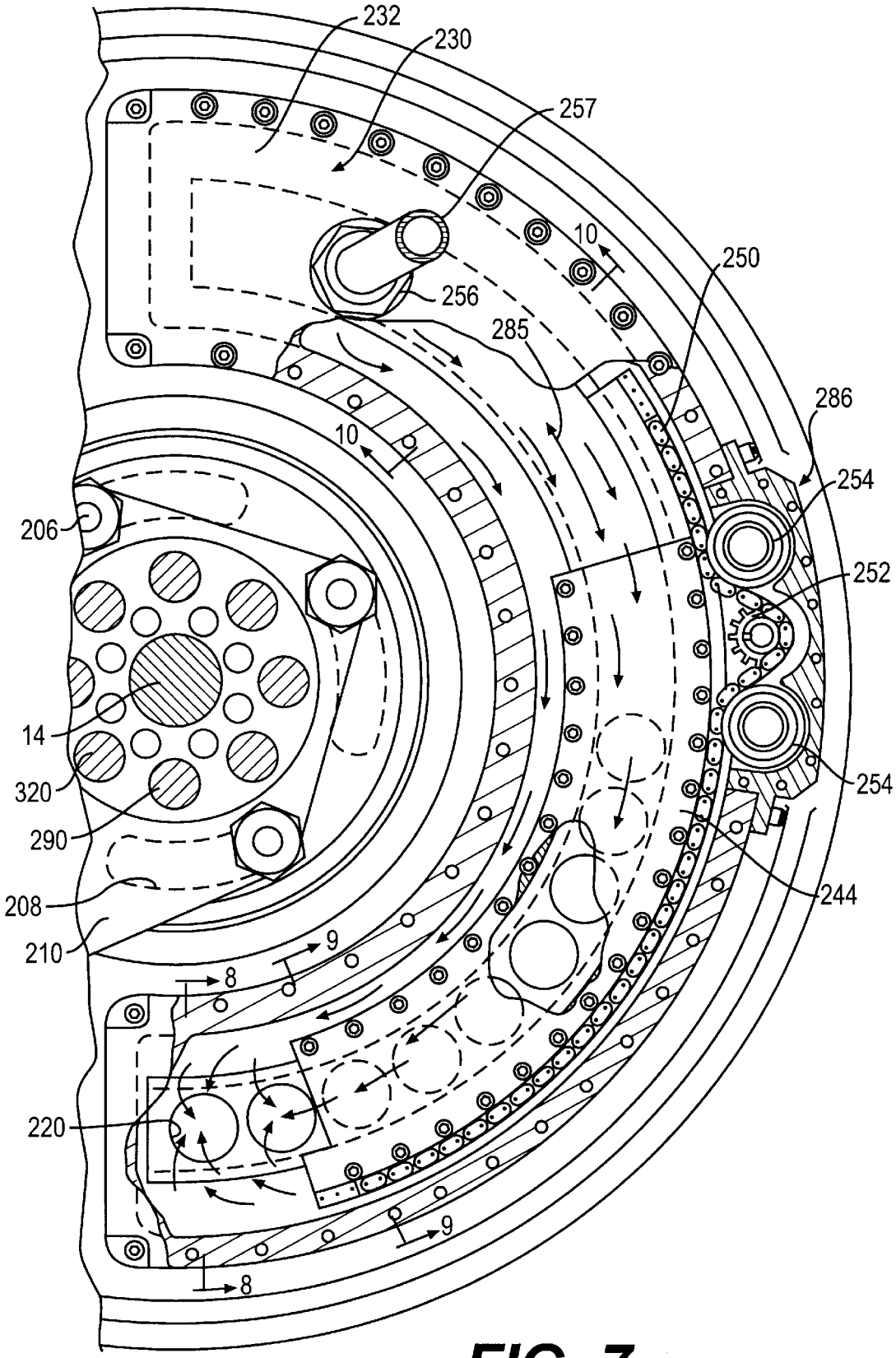
FIG. 7 is a partial sectional view of the interior of the manifold assembly of the present invention.

A drive chain 250, as shown in FIG. 7, is attached to the ends of base slider plate 244. Drive chain 250 is driven by gear 252 attached to an axle of a motor 253 mounted to distributor plate 200. Preferably, the motor is a hydraulic motor in communication with conduits 255 in communication with pump 28, although any suitable motor could be used. Idler rollers 254 are provided to ensure cooperation of drive chain 250 and gear 252. As shown by arrow 285 in FIG. 7, rotating gear 252 in either direction accordingly moves drive chain 250 and slider plates 242, 244. Moving the slider plates either covers or uncovers openings 220 in distributor plate 200. Working fluid is supplied to manifold 232 through an inlet fitting 256. Therefore, movement of slider plates 242, 244 determines how many of the openings 220 will be in communication with working fluid. As shown in FIG. 7, as many as all of the openings, or as few as none of the openings, can be placed in communication with the working fluid, as desired.

Figure 8:
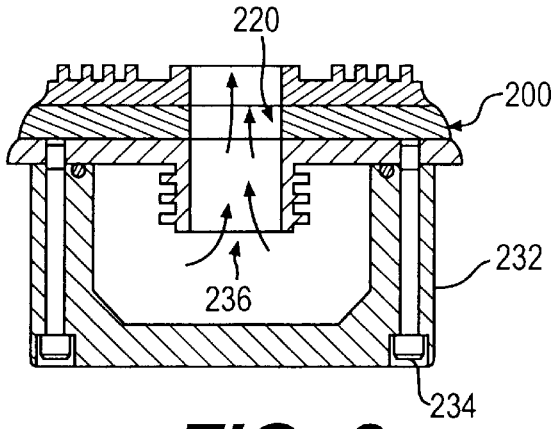
FIG. 8 is a partial sectional view of the manifold assembly of the present invention taken along line 8—8 of FIG. 7.
Figure 11:
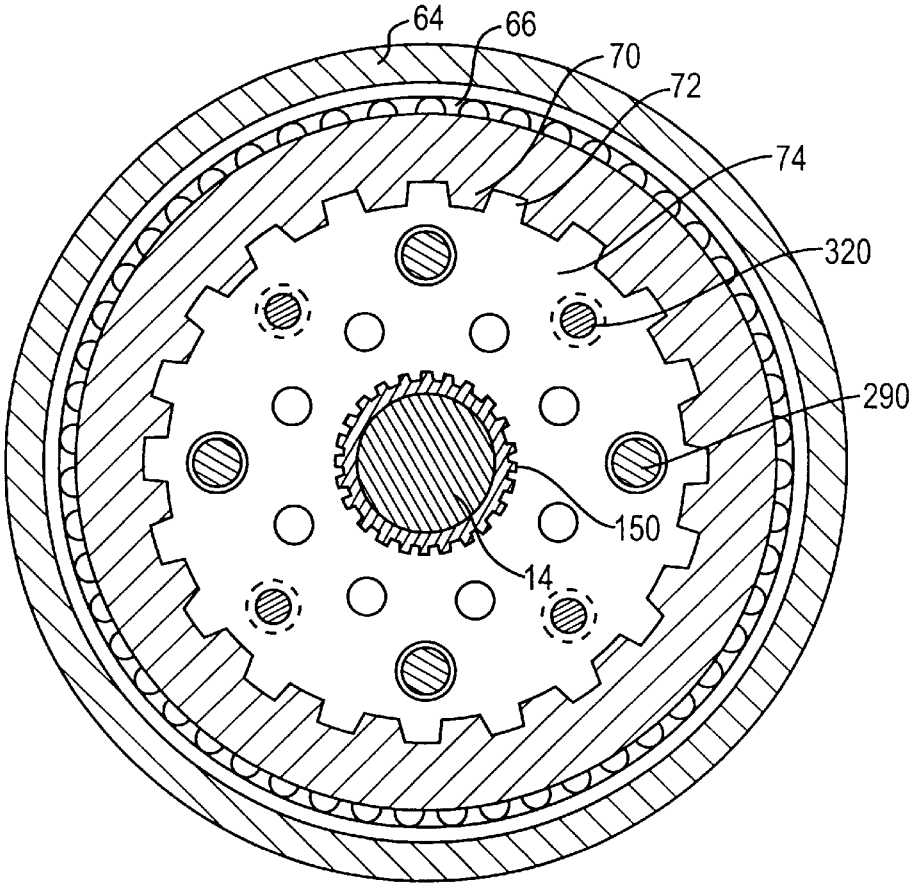
FIG. 11 is a partial sectional view of a portion of the present invention taken along line 11—11 in FIGS. 3C–3D.
Figure 9:
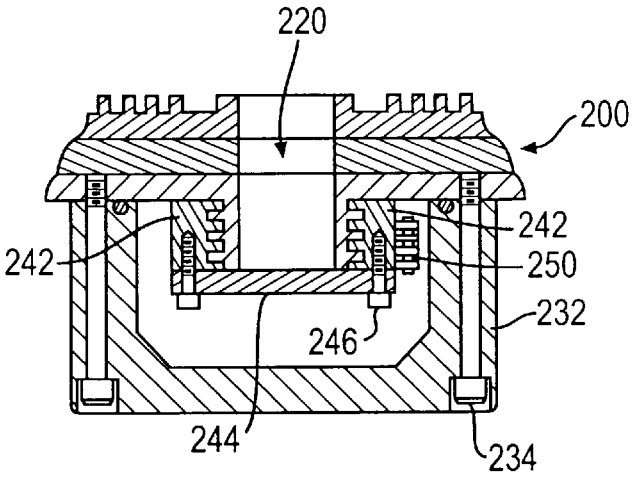
FIG. 9 is a partial sectional view of the manifold assembly of the present invention taken along line 9—9 of FIG. 7.
Figure 10:
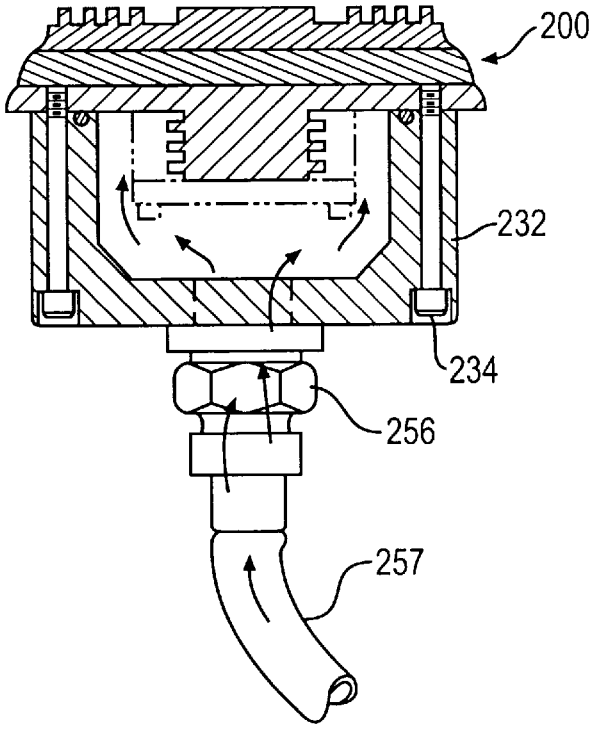
FIG. 10 is a partial sectional view of the manifold assembly of the present invention taken along line 10—10 of FIG. 7.
Figure 12:
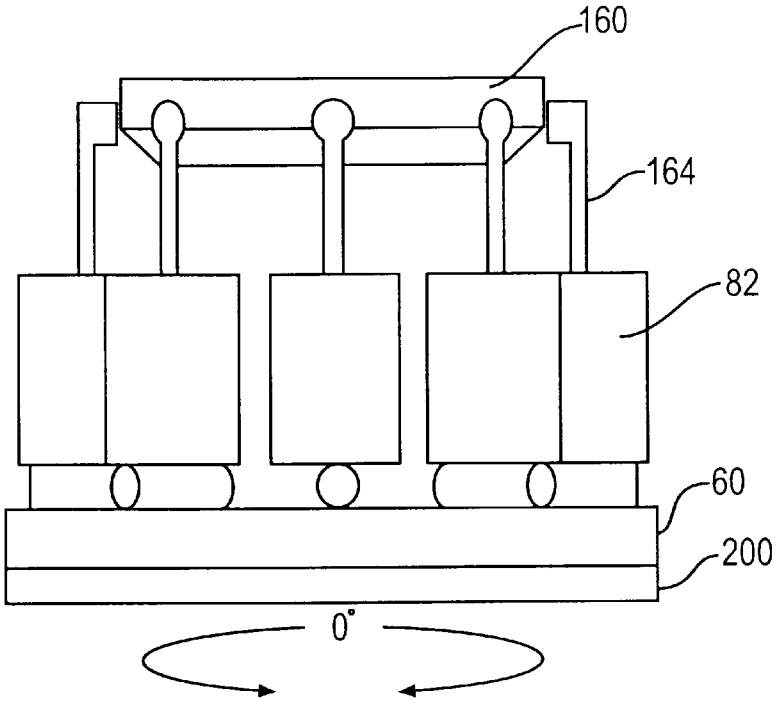
FIG. 12 is a diagram showing the piston-cylinder assemblies of the present invention in a non-inclined configuration.
Figure 13:
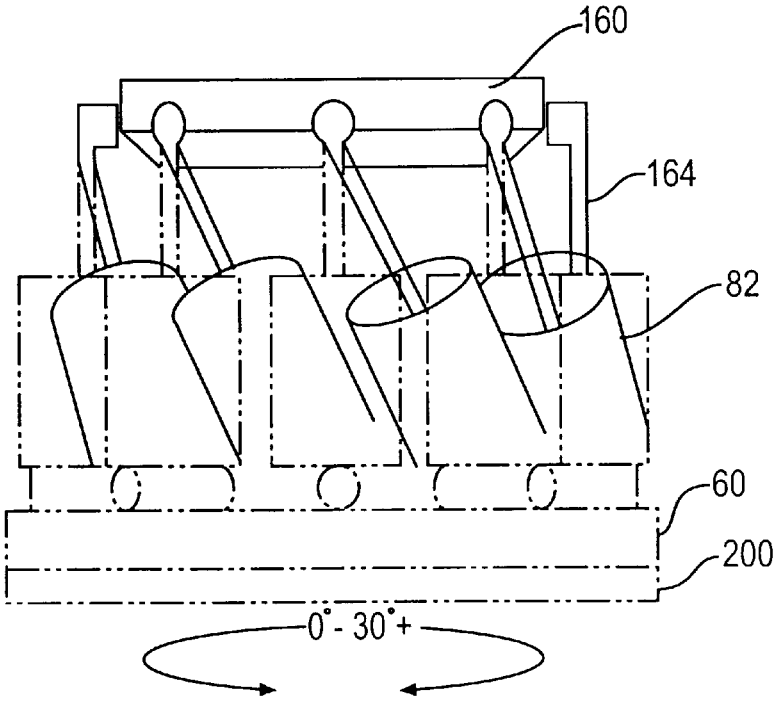
FIG. 13 is a diagram showing the piston-cylinder assemblies of the present invention in an inclined position.

FIG. 8 shows a portion of FIG. 3D wherein slider plates 242, 244 are not covering ridge 236. Therefore, as indicated by the arrows, working fluid travels from manifold 232 through opening 220. FIG. 9 shows a different section of manifold 232 in which slider plates 242, 244 cover opening 220, thereby preventing flow of working fluid into opening 220. FIG. 10 shows a portion of manifold 232 taken between two of the openings 220 in distributor plate 200. As shown, working fluid must travel along manifold 232 until it reaches an opening 220 not blocked by slider plates 242, 244 to enter journal boss 86.

Figure 16:
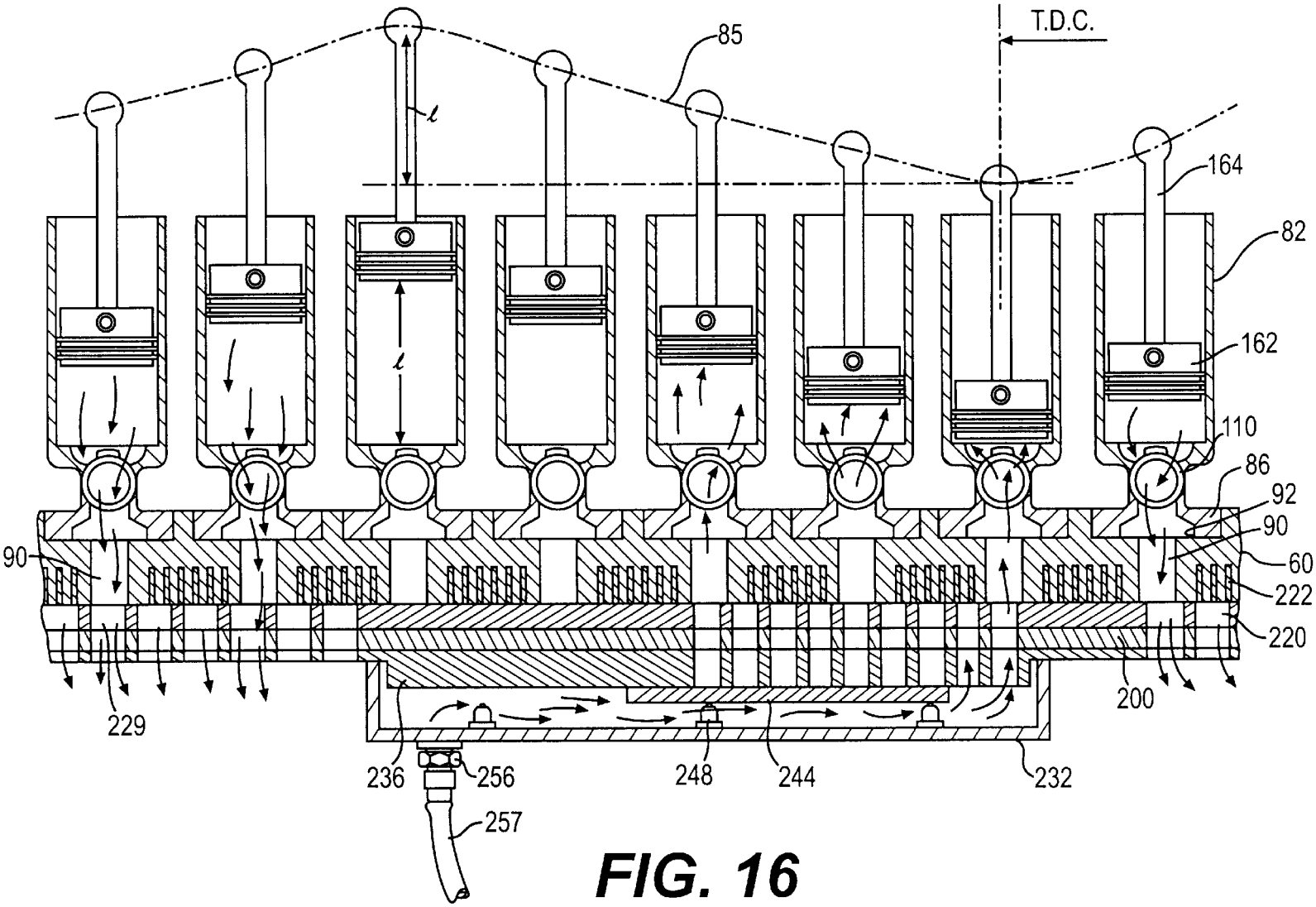
FIG. 16 is a diagram showing interaction of the manifold assembly with the piston-cylinder assembly during operation of the present invention.

FIG. 16 shows a view taken along a line at the radius of the openings 220 in distributor plate 200, showing the placement of the manifold assembly 230, the range of movement of the slider plates 242, 244, and the travel of working fluid from inlet fitting 256 into a journal boss 86. Any number of openings 220 and any length of slider plate 242 and 244 are possible within the scope of the invention. As will be discussed below, the number and placement of these elements are adjustable so that the device can be run under various parameters.

As shown in FIG. 6, the placement of distributor plate 200 and manifold assembly 230 can be moved relative to drive shaft 14 and collector plate 60 using hydraulic piston-cylinder 260. The piston 261 and piston arm 262 are attached to control plate 210, and the cylinder 264 is mounted to a plate 266 fixed to a bottom portion of distributor plate 200.

As discussed above, the control plate 210 is bolted to hub 204 and adaptor 68 by bolts 206. Bolts 206 slide in grooves 208 formed in distributor plate 200. Therefore, activation of the hydraulic piston-cylinder 260 causes distributor plate 200 and manifold assembly 230 to rotate about the drive shaft relative to hub 204 and adaptor 68, which do not relatively rotate due to interaction with gear 74. Collector plate 60 is also held in place through connection to drive shaft 14 by collar 138.

Thus, activation of hydraulic cylinder 262 moves distributor plate 200 relative to collector plate 60. Importantly, doing so changes the orientation about drive shaft 14 of openings 220 in distributor plate 200 relative to openings 90 in collector plate 60. Therefore, not only can the number of openings 220 subject to working fluid be altered by moving slider plates 242, 244, but also the circumferential position of openings 220 that are in communication with openings 90 can be altered by using hydraulic-cylinder 260. This adjustability will be discussed in greater detail below.

As shown in FIG. 2A, inlet fitting 256 is connected via conduit 257 to housing inlet fitting 258 which is connected to a source of working fluid (not shown). Conduit 257 should be flexible to account for movement of manifold assembly 230 and distributor plate 200 around drive shaft 14.

As shown in FIG. 6, openings 229 are provided in distributor plate 200 to exhaust used working fluid from cylinders 82. The number and arrangement of openings 229 is a matter of design choice. If desired, a second set of slide plates 242, 244 may be driven to open and close openings 229 to alter the performance of the device. FIG. 16 shows working fluid leaving openings 229 during the return stroke of pistons 162. Working fluid entering housing 12 from openings 229 is vented from housing via holes 42 and outlet fixture 44.

Adjustment assembly 22 includes several subassemblies, many of which overlappingly include a number of the parts already described above. Operation of the subassemblies may be performed either prior to or during operation of the entire device to choose or alter operation parameters.

Adjustment assembly 22 includes a rotor hub adjustment subassembly 280, a distributor plate adjustment subassembly 282, a manifold adjustment subassembly 284, a slider plate adjustment subassembly 286, and a piston collar adjustment subassembly 288. Most of the elements of these subassemblies have already been discussed, and the interrelationship of these elements with other parts of the device will be explained below.

As shown in FIGS. 2A and 2B, rotor hub adjustment subassembly 280 includes a jacking screw 300 for moving a threaded block 302. Threaded block 302 is connected to yoke 184 via a linkage 304. Linkage 304 includes a connecting link 306 secured at one end to threaded block 302 and at the other end to control arm 308. Alternately, control arm 308 could be secured directly to threaded block 302. As shown in FIG. 14, control arm 308 is also attached to the plates 190A, 190B attached to end wall 38 by a pin 309 extending between plates 190A, 190B. Thus, control arm 308 pivots about pin 309 as threaded block 302 moves along jacking screw 300. Two connecting links 310 are attached to the control arm 308 and to yoke 184. Jacking screw 300 is driven by motor 312 (preferably an electric motor), a drive chain 314, and gears 316. However, any other suitable driving mechanism could be used, such as a hydraulic motor, or a manual crank.

When motor 312 is operated to rotate jacking screw 300, threaded block 302 is moved up or down along jacking screw 300, thereby pivoting control arm 308 about pin 309 and, via connecting links 310, pivots yoke 184, retainer 180, and rotor hub 160 about pivot pins 194 extending from plates 190A, 190B. Thus, operation of motor 312 to rotate jacking screw 300 can move rotor hub 160 from the position shown in FIG. 2A to the position shown in FIG. 2B. The degree of adjustment possible is defined by the design of the jacking screw 300, threaded block 302, and linkage 304. The degree of adjustment is also a factor of the degree of adjustability of the orientation of pistons in the cylinders 82, as will be discussed below. Use of a control arm 308 and yoke 184 and connecting links 306, 310, rather than direct connection of threaded block 302 to yoke 184, beneficially minimizes vibration of the device during operation.

The adjustment of the position of rotor hub 160 can be done while the entire device is operating, or can also be done while the device is stopped. Tilting rotor hub 160 causes the stroke length, (See FIG. 16) of pistons 162 to be altered. For example, with rotor hub 160 in the position shown in FIG. 2A (rotor hub extending substantially perpendicular to drive shaft 14), the stroke length of pistons 162 is zero. Thus, when in the position shown in FIG. 2A, the expander is essentially in "neutral," and will not run in either direction regardless of at which point about the drive shaft 14 operating fluid is introduced into the cylinders.

When rotor hub 160 is in the position of FIG. 2B (tilted from a position perpendicular to drive shaft 14), pistons 162 have a certain stroke length which is essentially the distance between the highest (rightmost in FIG. 2B) piston 162 and the lowest (leftmost in FIG. 2B) piston within cylinders 82 in a direction parallel to the drive shaft 14. (See FIG. 16 for linear representation of stroke length l) If cylinders 82 were themselves tilted, as will be described below, the stroke length would be calculated along the direction of the center line of the cylinders, rather than along the direction of drive shaft 14. When rotor hub 160 is tilted, as shown in FIG. 2B, it rotates via constant-velocity universal joint 170 about drive shaft 14. However, rotor hub 160 rotates about axis skewed from an orientation parallel to the longitudinal axis 62 of drive shaft 14.

Tilting rotor hub 160 adjusts the output torque of drive shaft 14. The more tilt provided, the longer the piston stroke, and the higher the torque obtained, all other set-up parameters being equal.

Similarly, tilting rotor hub 160 also adjusts the output speed of rotation of drive shaft 14. The lesser tilt provided, the shorter the stroke length, the greater the speed of rotation.

Piston collar adjustment subassembly 288 includes threaded cylinder 148 mounted on support shaft 150, as shown in FIG. 3D. Jacking screws 290 are threaded into threaded cylinder 148 so that rotation of jacking screws 290 causes threaded cylinder 148 to slide along support shaft 150 and causes piston collar 138 to slide along drive shaft 14. Due to the interconnection of piston-cylinder assembly 80, collector plate 60, and distributor plate 200, operation of piston collar adjustment subassembly 282 slides the entire portion of the device from the manifold 232 to the piston hub 136 along shafts 14 and 150. Depending on whether gear 74 is also moved in synch with threaded cylinder 148, the distributor plate 200 and manifold assembly 230 may or may not rotate during the sliding movement. This operation will be discussed below.

Figure 5:
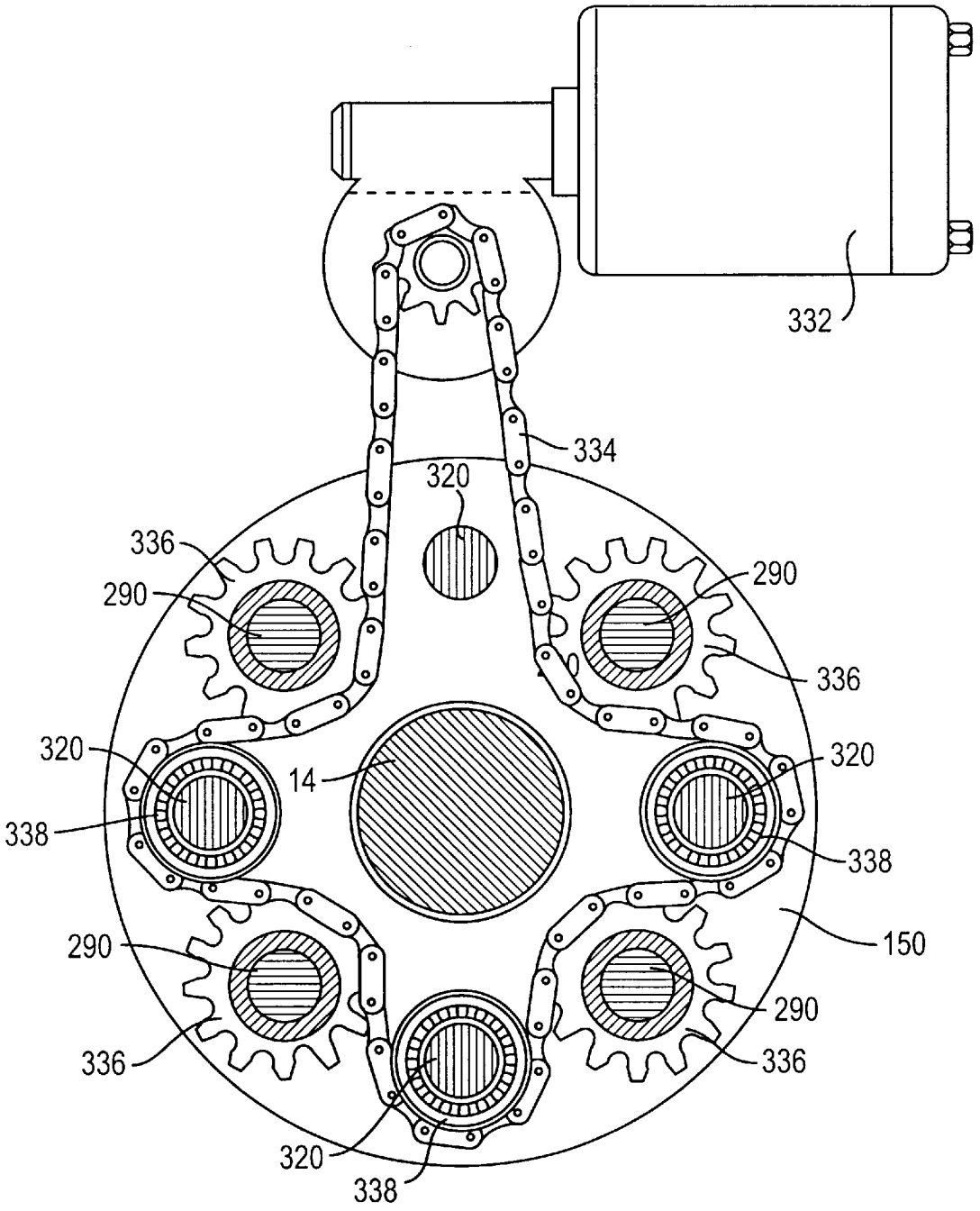
FIG. 5 is a partial sectional view of the present invention, taken along line 5—5 in FIG. 2A.

As shown in FIG. 5, motor 332 drives chain 334 around gears 336 secured to jacking screws 290 and idlers 338 disposed around jacking screws 320. Idlers 338 may be ball bearings that allow drive chain 334 to pass around them without interfering with the operation of the jacking screws 290, 320 within the idlers. Motor 332 may be of any suitable design, such as electric, hydraulic, etc.

Figure 4:
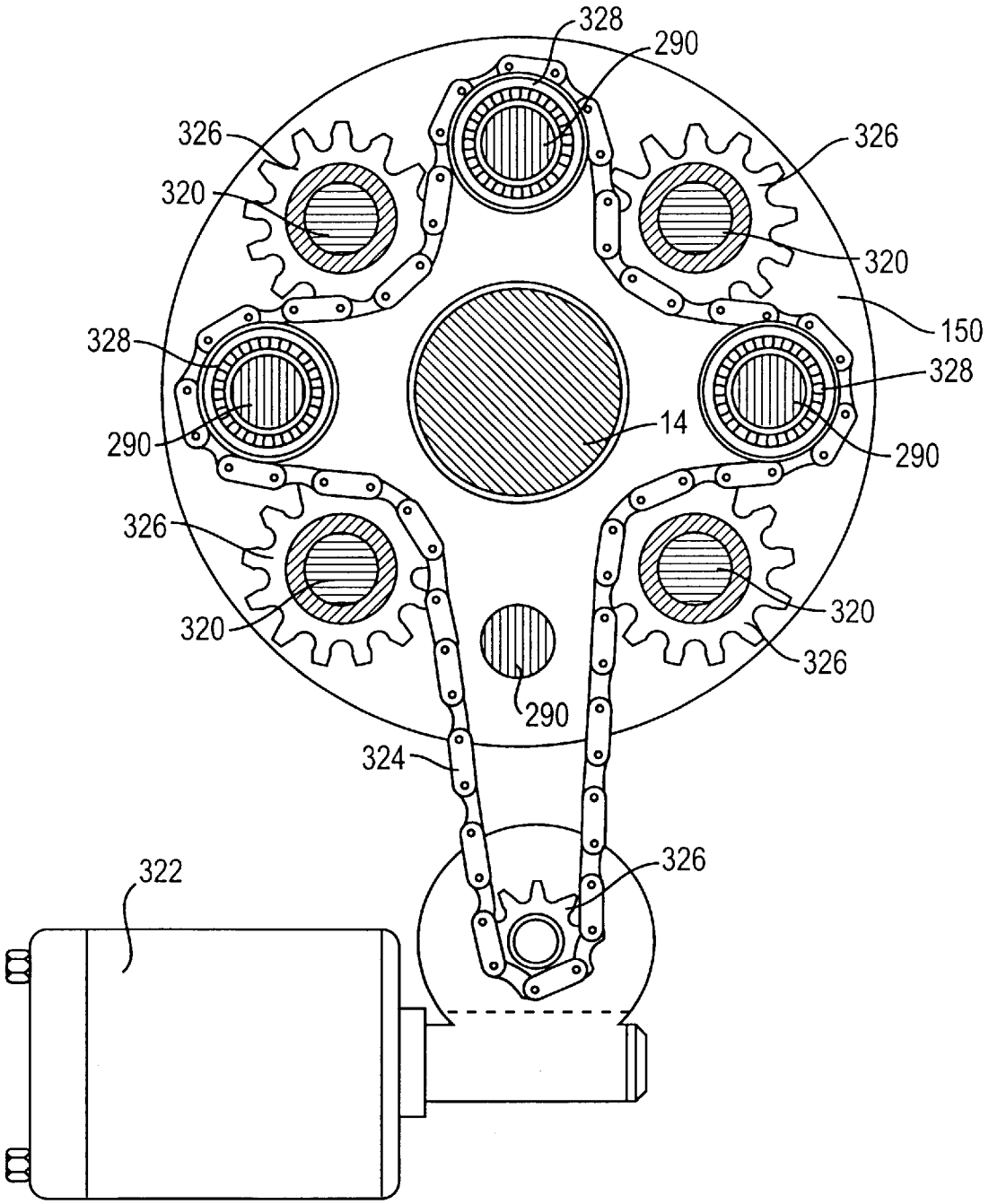
FIG. 4 is a partial sectional view of the present invention, taken along line 4—4 in FIG. 2A.

Distributor plate adjustment subassembly 282 includes jacking screws 320 threaded into gear 74. Jacking screws 320 are driven by a motor 322, drive chain 324, and gears 326 as shown in FIG. 2A. As shown in FIG. 4, motor 322 may drive jacking screws 320 via drive chain 324 disposed around gears 326 secured to jacking screws 320 and idlers 328 secured to jacking screws 290. The design and operation of the elements shown in FIG. 4 are essentially similar to those shown in FIG. 5.

Operation of motor 322 to drive jacking screws 320 may cause one of several things to happen depending on operation of other parts of the device. For example, if jacking screws 290 and 320 are driven at the same time so as to slide gear 74 and threaded cylinder 148 along support shaft 150 at the same speed, all parts between manifold 232 and collar 138 will slide along drive shaft 14 and support shaft 150. Distributor plate 200 will not rotate relative to collector plate 60. Cylinders 82 will not change inclination relative to drive shaft 14. However, the clearance c between pistons 162 and cylinders 82 will be changed. (See FIG. 3D) Changing the clearance may be required due to change in stroke due to tilting of the rotor hub 160, or be done simply to change the parameters of the thermodynamic cycle occurring within the cylinders 82 by changing the working volume of the cylinders 82.

If jacking screws 320 are rotated without rotating jacking screws 290, the distance along drive shaft 14 between collar 138 and collector plate 60 will be altered. Therefore, the inclination of cylinders 82 will be altered, and collector plate 60 and distributor plate 200 will rotate about the drive shaft 14, as described above.

There is no reason to rotate jacking screws 290 alone. However, they may be rotated with jacking screws 320 to adjust the axial position of the cylinders 82, as discussed above. Thus, either one or both sets of jacking screws 290, 320 may be used to position distributor plate 200, collector plate 60, cylinders 82, etc. in a desired orientation. If the rotor hub 160 has been moved by jacking screw 300, it may be necessary to adjust the axial and circumferential location of the other parts to ensure proper piston 162 clearance c within cylinders 82 and to obtain desired output characteristics. For example, changing the inclination of the cylinders 82 using jacking screws 320 alters the output speed of drive shaft 14 and the output torque of drive shaft 14.

The angle of the inclined spline in gear 74 will determine the amount of rotation of collector plate 60 and distributor plate 200 provided by movement of gear 74. Preferably, spline gear 74 should be able to drive distributor plate 200 in either direction far enough (in the range of 45° around longitudinal axis 62) to decline cylinders 82 to an orientation angled at least 30° from parallel to longitudinal axis 62. A 30° angling will provide a pressure angle of approximately 23° between the wrist pin assemblies 100 and the ball joints 168 due to the pivoting of the cylinders 82 on pins 130 during movement of the cylinders. If desired, gear 74 and adaptor 68 can be made in a single part, eliminating the splined interconnection of these ports. However, the splines 70, 72 are useful to help rotate collector plate 60 to decline cylinders 82 while the device is not running and prevent stripping of the jacking screws 320 or its gear and chain drive during operation. Also, the splines 70, 72 absorb vibration during use.

Manifold adjustment subassembly 284 includes hydraulic piston-cylinder 260, piston 261, piston arm 262, conduit 263, cylinder 264, and plate 266, control plate 210, and bolt 206. When hydraulic piston-cylinder 260 is operated, distributor plate 200 and manifold assembly 230 are moved as a unit relative to collector plate 60. Such movement changes the circumferential position relative to the longitudinal axis 62 of drive shaft 14 at which working fluid is supplied to and exhausted from piston-cylinder assembly 80. Because the rotor hub 160 does not change its inclination relative to longitudinal axis 62 while it rotates around the longitudinal axis, moving distributor plate 200 circumferentially around longitudinal axis 62 changes the position within the piston travel cycle at which fluid is introduced and exhausted from the piston-cylinder assemblies 80.

If desired, the hydraulic cylinder 260 may be replaced by a ring gear and worm screw arrangement (not shown). The worm screw can be driven by a hydraulic motor. If this arrangement is used, the bolt 206 and groove 208 arrangement can be eliminated, thus allowing the manifold assembly 230 to be rotated around the central axis with less limitation.

The results of moving distributor plate 200 relative to collector plate 60 via hydraulic cylinder 260 are demonstrated in FIG. 16. In FIG. 16, the travel of the cylinders 82 is shown by the arcuate dotted line 85. Movement of distributor plate 200 relative to collector plate 60 would, in FIG. 16, slide distributor plate 200 and connected parts laterally, thereby changing the admission and exhausting points for the cylinders.

Doing so can change the thermodynamic cycle of the working fluid, and can change the direction of operation of the device. For example, if distributor plate 200 were driven just over one cylinder 82 to the right, the direction of rotation of the collector plate 60 and cylinders 82 would be reversed. Movement of distributor plate 200 by hydraulic cylinder 260 relative to collector plate 60 and rotor hub 160 can be done either prior to or during operation of the device. Thus, the direction of operation of the device can be changed without using gearing or a transmission, merely by rotating distributor plate 200.

Slider plate adjustment subassembly 286 includes slider plates 242 and 244, ball bearings 248, drive chain 250, gear 252, and motor 253. Motor 253 is used to move slider plates 242 and 244 relative to ridge 236 to either cover or uncover openings 220 extending through ridges 236 and distributor plate 200. As illustrated best in FIG. 16, movement of the slider plates 242 and 244 changes the number of openings 220 extending through distributor plate 200 and ridge 236 that are in communication with the inside of manifold 232, and therefore with the supply of working fluid. In FIG. 16, two openings 220 are in communication with the inside of manifold 232. Movement of slider plates 242 and 244 effectively changes the thermodynamic cycle by altering the period during which admission and expansion occurs. A longer period of admission provides greater power. A longer period of expansion provides greater efficiency. As mentioned above, a similar slider plate assembly can be used with openings 22 for exhausting working fluid from cylinders 82.

If desired, the control of the various motors and jacking screws can be provided using sensors and a feedback loop. For example, holes 75 through gear 74 can be provided for feeding wires to electrical sensors or mechanical cables. Preferably, cables could be used, thereby allowing electric switches to be placed on the outside of housing 36 away from lubricant and working fluid. The sensors could be operated to activate jacking screws 290, 320 after a change in orientation of rotor hub 160 in order to obtain proper piston and cylinder clearance. Also, such sensors can provide feedback to indicate whether the various portions of the expander of assembly 10 have been properly adjusted and to cause the various motors within the device to fine-tune the adjustment if necessary. The sensors can be attached to gear 74, threaded block 148, distributor plate 200, manifold 232, or sliding plate 244, as desired. Also, a sensor can be placed on arm 308 as well.

FIG. 17 shows how the rotary fluid expander assembly 10 can be used in a Rankine cycle. In the Rankine cycle, pressurized working fluid is provided to fluid expander assembly 10 by boiler 340 heated by burners 342 fed with fuel from fuel storage tank 344 by fuel pump 346. A throttle valve 347 is disposed in the line between the boiler 340 and the fluid expander 10. Used working fluid and lubrication are separated in separator 348, the lubricant being returned to the expander assembly 10, and the working fluid passing through condenser 350 and pump 352. Condenser 350 may be driven by an alternator 354 and battery 356 powered by drive shaft 14.

FIG. 18 shows an alternate cycle, similar to that shown in FIG. 17. In FIG. 18, a compressor 358 driven by drive shaft 14 is inserted between separator 348 and condenser 350. Also, in FIG. 18, some working fluid is transferred directly from boiler 340 to fluid expander 10. This would serve as a safety excess dumping conduit on a relieve pressure from the boiler to recover working fluid.

FIG. 19 shows another alternate arrangement in which fluid expander 10 is used within a Brayton cycle. In this cycle, working fluid exiting fluid expander 10 passes into a combustion air preheater 360 operated on by a compressor 358 driven by drive shaft 14. Preheated air exits the preheater 360 and enters combustion chamber 362.

Figure 20:
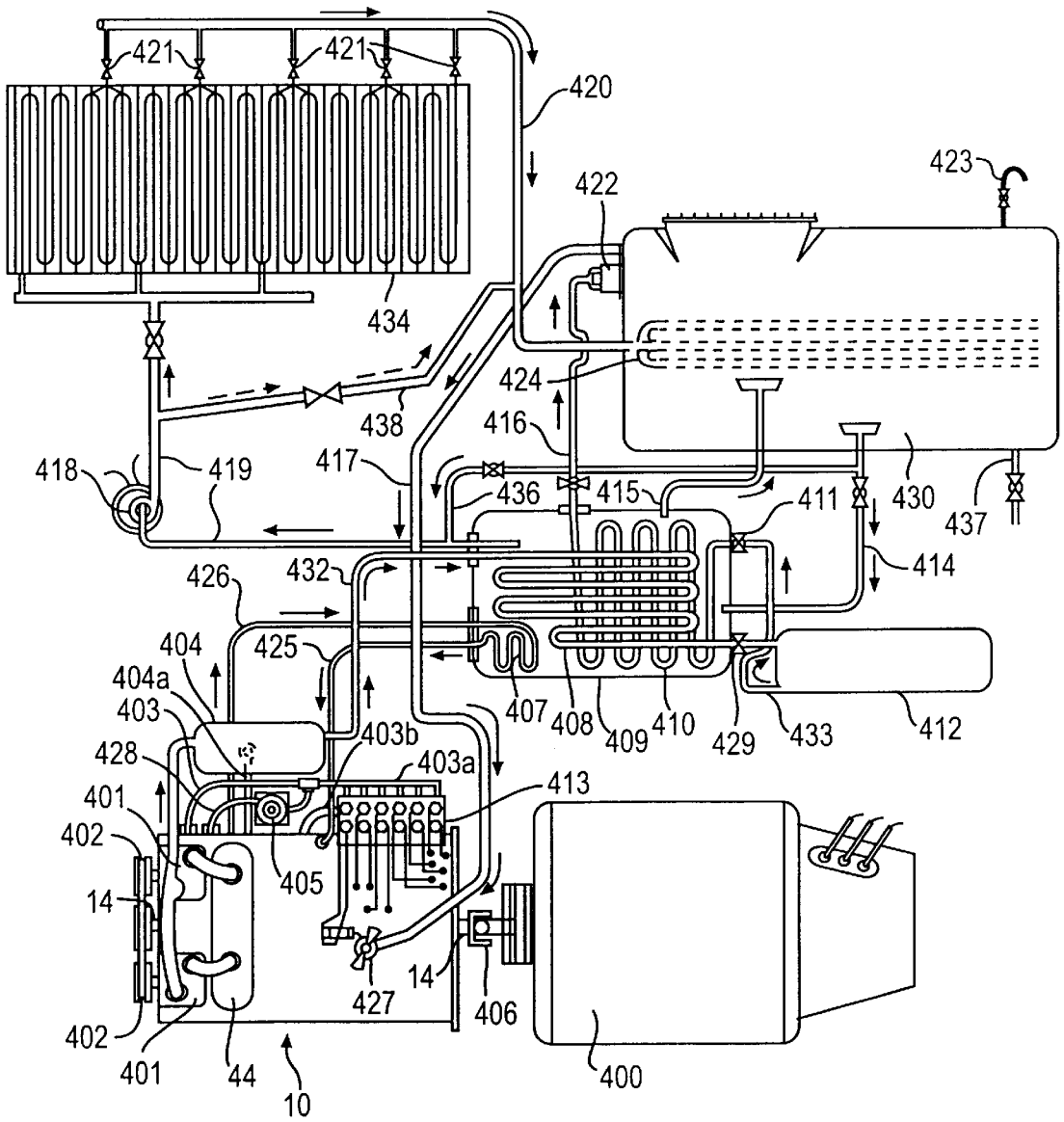
FIG. 20 is a diagram showing one possible solar energy system in which the present invention could be used.

The fluid expander assembly 10 also is well-suited for use in solar or geothermal energy systems. For example, as shown in FIG. 20, the expander assembly 10 can be utilized in a solar energy system to generate electricity via a generator or alternator 400. The system includes a solar collector 434, a heat sink such as a storage tank 430, a heat exchanger 409, and associated coils and conduits for transferring working fluid, lubricant, and energy collecting fluid. Water is heated within coils of solar collector 434 and passes through thermostatic valves 421 into conduit 420. Water continues into diffuser 424 within storage tank 430 which holds water and bricks or granite acting as a heat sink. Storage tank 430 is filled via fill valve 437 and vented via vent 423. Water is circulated from main storage tank 430 via conduit 414 and enters heat exchanger 409. Water exits heat exchanger 409 via conduit 419 due to the action of pump 418. If desired, water may bypass heat exchanger 409 via bypass conduit 436. Water in conduit 419 may return to solar collector 434, or may bypass the solar collector via bypass conduit 438, which would be used, for example, at night. Conduit 415 allows water to return from heat exchanger 409 to storage tank 430. Cross connections are utilized to make use of exchanger 409 as an efficient heat recovery unit.

Working fluid is supplied to expander 10 via conduit 417, as controlled by throttle valve 427. Spent working fluid exits expander 10 via outlet fixture 44. Vane type pumps 401 driven by electric clutches 402 drive the working fluid into lubricant separator 404. Lubricant is returned to expander via conduit 404A, and used working fluid is pumped into coils 408 within heat exchanger 409 via conduit 432 as a high pressure hot gas where it is condensed into a liquid form under high pressure. The used working fluid is then transferred past valve 429 into working fluid liquid reservoir 412, past expansion valve 411 back into heat exchanger 409, through coils 410, to preheat and then back into main storage tank 430 via conduit 416 and header 422 of closed coils to gain heat to add pressure to the gas form of working fluid.

Lubricant travels via conduit 426 into cooling coil 407 in heat exchanger 409, back into expander 10 via return conduit 425 due to action of pumps 28. When expander is stopped, electric hydraulic pump 405 controls hydraulic valves 413 for controlling various motors and piston cylinders within expander 10. Conduits 403A and 403B are used to drive valves 413 and return used hydraulic fluid to expander 10.

Figure 21:
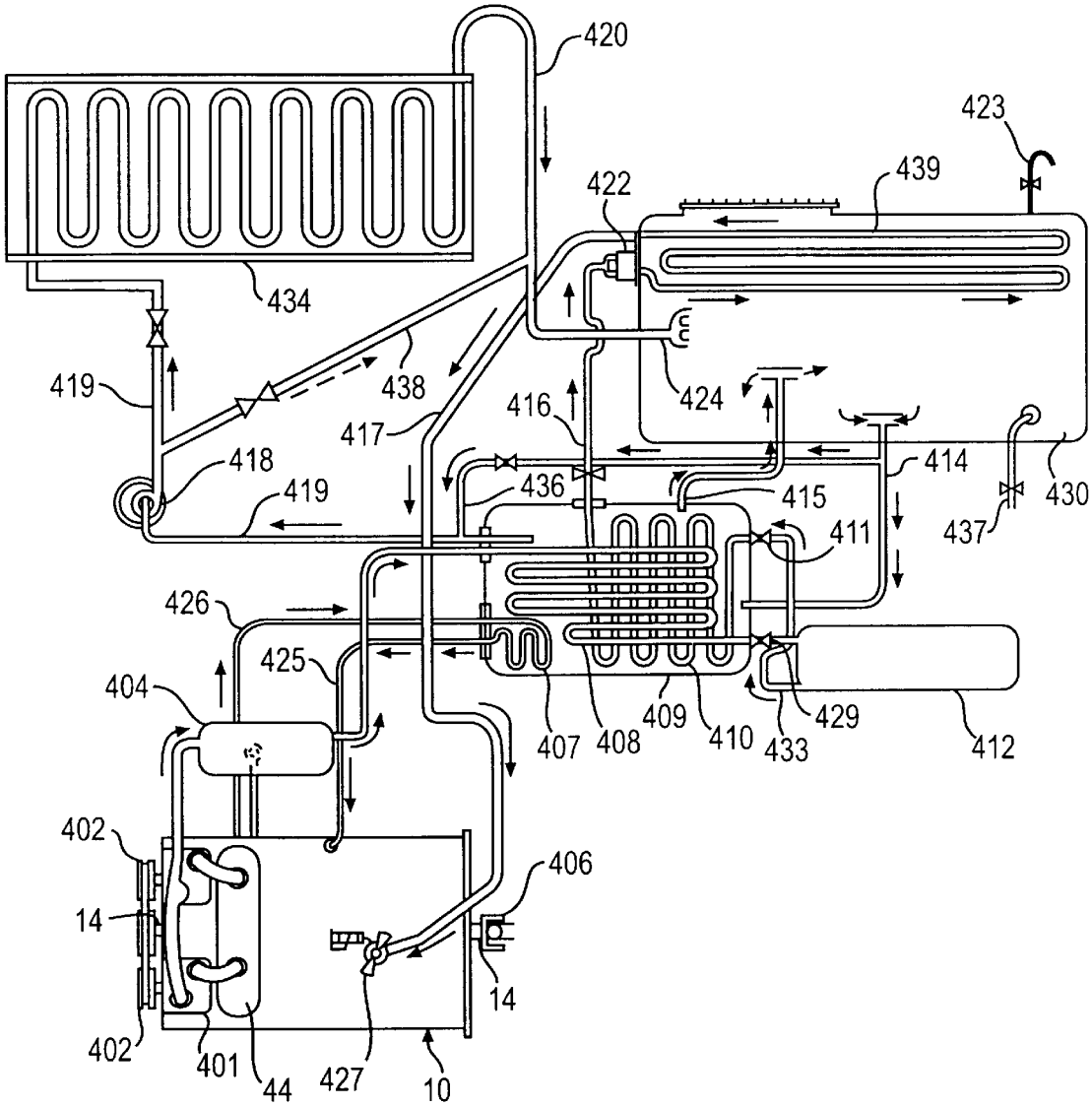
FIG. 21 is a diagram showing a second possible solar energy system in which the present invention could be used.

FIG. 21 shows an alternate solar energy system in which the working fluid is kept separate from the solar energy collecting fluid. Thus, as shown, a coil 439 is provided in storage tank 430 for communicating header 22 with conduit 417 to keep the fluid passing through solar collection 434 and storage tank 430 separate from the working fluid. Otherwise, the systems of FIGS. 20 and 21 are similar.

Figure 22:
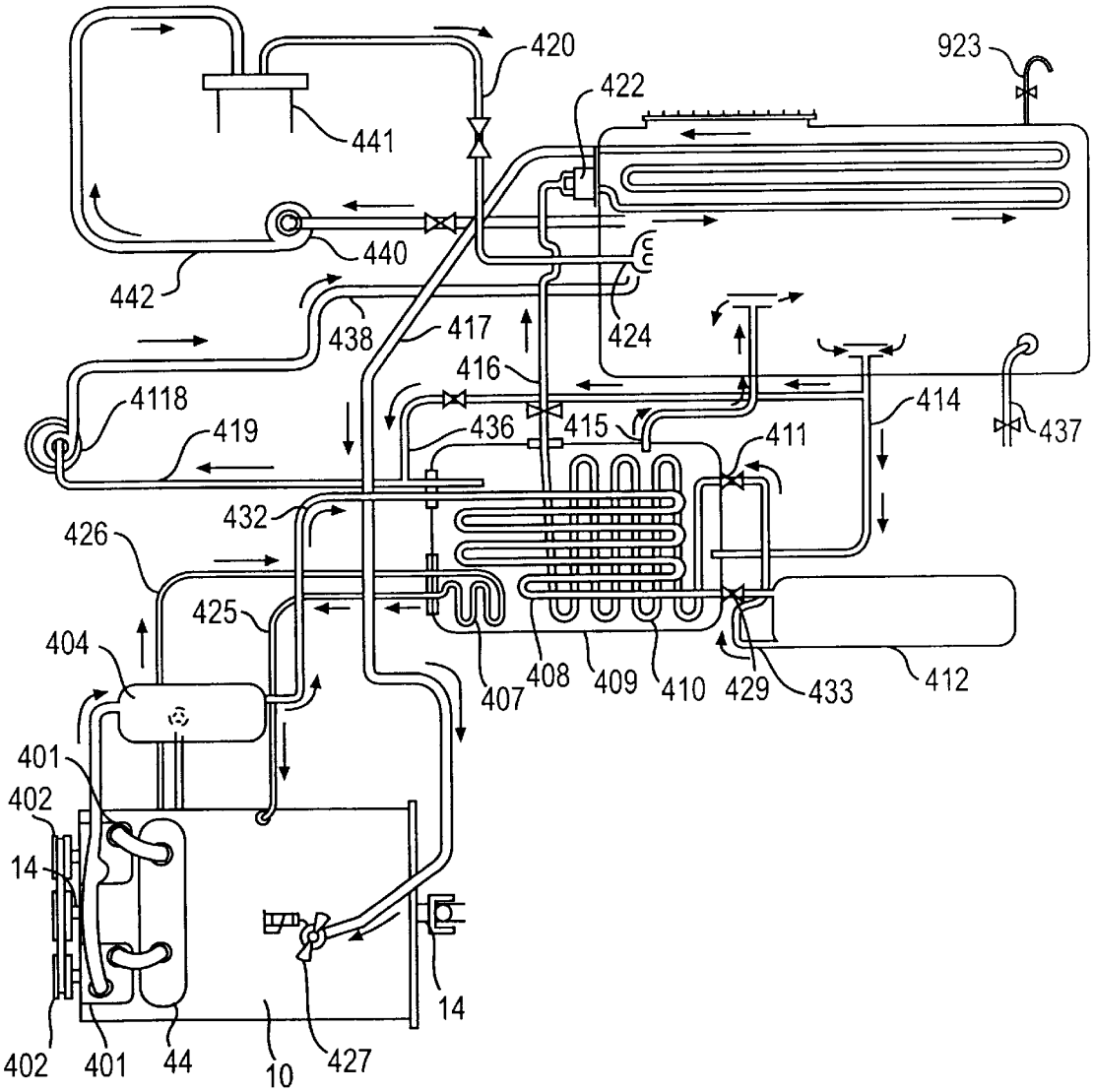
FIG. 22 is a diagram showing one possible geothermal energy system in which the present invention could be used.

FIG. 22 shows a geothermal energy system similar to the solar energy system of FIG. 21. However, in FIG. 22, the thermal energy source is a well head 441. A pump 440 is provided for returning water directly from main storage tank 430 to well head 441 via conduit 442. In the above systems FIGS. 21 and 22, the working fluid could be a refrigerant gas such as Freon 12 or Dupont 134.

Solar and geothermal systems can readily be adapted to provide 30–50 p.s.i. and, accordingly the horsepower output described above. The present invention is therefore especially suitable for supplying energy in regions of the world where solar and geothermal energy sources are abundant.

The present invention thus provides an adjustable rotary fluid expander that can be used in various cycles and under various parameters. The timing and duration of the fluid supplying, expansion, and exhausting into cylinders are all readily adjustable, either before operation or during operation. A continuous flow of power uninterrupted by gear changing and unencumbered by complicated transmission or other gearing is thus provided. Further, the fluid expander assembly is operable at pressures much lower than other currently available devices, both internal combustion and external combustion.

It should be apparent to those skilled in the art that various modifications and variations can be made in the present invention without departing from the spirit and scope of the invention. For example, parts indicated and described as separate parts can be combined together into single parts, or vice versa. Thus, various arrangements of gears, jacking screws, hubs, etc. may be employed within the scope of the invention in order to achieve the adjustable fluid expander described herein.

What is claimed is:

1. A fluid expander assembly comprising:

a housing;

a drive shaft mounted for rotation within the housing and having a longitudinal axis;

a first member mounted for rotation with the drive shaft about the longitudinal axis;

a second member mounted for rotation with the drive shaft about an axis adjustably skewed from an orientation parallel to the longitudinal axis of the drive shaft;

a piston-cylinder assembly including a cylinder secured to the first member and a piston secured to the second member and disposed within the cylinder;

a pressurized fluid source for providing pressurized fluid to the piston-cylinder assembly to rotate the drive shaft via the first and second members; and a first adjustment assembly for varying an output speed of rotation of the drive shaft by moving one of the first or second members along the longitudinal axis of the drive shaft relative to the other.

2. The fluid expander assembly of claim 1, wherein the piston-cylinder assembly includes a plurality of cylinders mounted to the first rotatable member.

3. The fluid expander assembly of claim 1, further including a second adjustment assembly for varying a stroke length of the piston by adjusting the orientation of the axis about which the second rotatable member rotates.

4. The fluid expander assembly of claim 1, further including a second adjustment assembly for selecting a direction of rotation of the drive shaft by varying a circumferential position relative to the longitudinal axis of the drive shaft at which the working fluid is supplied to the piston-cylinder assembly and for varying a circumferential position relative to the longitudinal axis of the drive shaft at which the working fluid is exhausted from the piston-cylinder assembly.

5. The fluid expander assembly of claim 1, wherein the adjustment assembly varies an output torque of the drive shaft by moving the one of the first or second members along the longitudinal axis of the drive shaft relative to the other.

6. The fluid expander assembly of claim 1, further including a second adjustment assembly for varying an output torque of the drive shaft by adjusting the orientation of the axis about which the second member rotates.

7. The fluid expander assembly of claim 1, further including a second adjustment assembly for varying an output speed of rotation of the drive shaft by varying a circumferential length relative to the longitudinal axis of the drive shaft at which the working fluid is supplied to the piston-cylinder assembly.

8. The fluid expander assembly of claim 1, further including a second adjustment assembly for varying an output speed of rotation of the drive shaft by adjusting the orientation of the axis about which the second member rotates.

9. The fluid expander of claim 1, further including a second adjustment assembly for varying an output power of the drive shaft by varying a circumferential length relative to the longitudinal axis of the drive shaft at which the working fluid is supplied to the piston-cylinder assembly.

10. A fluid expander assembly comprising:

a housing;

a drive shaft mounted for rotation within the housing and having a longitudinal axis;

a piston-cylinder assembly mounted for rotation with the drive shaft and having a longitudinal axis, the piston-cylinder assembly including a piston and a cylinder for converting energy from a working fluid to rotational energy output via the drive shaft; and an adjustment assembly for varying an orientation of the longitudinal axis of the piston-cylinder assembly relative to the longitudinal axis of the drive shaft by rotating the cylinder about the longitudinal axis of the drive shaft.

11. The fluid expander assembly of claim 10, further including a first member and a second member each mounted for rotation with the drive shaft, the piston-cylinder assembly being mounted between the first and second members, the adjustment assembly varying the relative orientation of the longitudinal axes by rotating one of the first or second members relative to the other about the longitudinal axis of the drive shaft.

12. The fluid expander assembly of claim 11, wherein the adjustment assembly includes a drive rod and gearing, the drive rod being for rotating one of the first or second members relative to the other via the gearing.

13. A fluid expander assembly comprising:

a housing;

a drive shaft mounted for rotation within the housing and having a longitudinal axis;

a piston-cylinder assembly mounted for rotation with the drive shaft, the piston-cylinder assembly including a piston and a cylinder for converting energy from a working fluid to rotational energy output via the drive shaft;

a first adjustment assembly for varying a length of stroke of the piston within the cylinder; and a second adjustment assembly for moving one of the piston and the cylinder relative to the other for varying piston head clearance without varying the length of stroke.

14. The fluid expander of claim 13, further including a first member and a second member each mounted for rotation with the drive shaft, the cylinder being mounted to the first member and the piston being mounted to the second member, the first adjustment assembly varying the length of stroke by tilting the second member relative to the longitudinal axis of the drive shaft.

15. The fluid expander assembly of claim 14, wherein the first adjustment assembly includes a drive rod and a linkage, the drive rod being for tilting the second member relative to the longitudinal axis of the drive shaft via the linkage.

16. The fluid expander assembly of claim 13, further including a first member and a second member each mounted for rotation with the drive shaft, the cylinder being mounted to the first member and the piston being mounted to the second member, the second adjustment assembly varying the piston head clearance by moving the first member along the longitudinal axis of the drive shaft.

17. The fluid expander assembly of claim 16, wherein the second adjustment assembly includes at least one set of jack screws for moving one of the piston and the cylinder relative to the other.

18. The fluid expander assembly of claim 13, further including a first member and a second member each mounted for rotation with the drive shaft, the cylinder being mounted to the first member and the piston being mounted to the second member, the second adjustment assembly varying the piston head clearance by rotating the first member about the longitudinal axis of the drive shaft.

19. A fluid expander assembly comprising:

a housing;

a drive shaft mounted for rotation within the housing;

a piston-cylinder assembly mounted for rotation with the drive shaft, the piston-cylinder assembly including a piston and a cylinder for converting energy from a working fluid to rotational energy output via the drive shaft; and an adjustment assembly for varying a circumferential position relative to the longitudinal axis of the drive shaft at which the working fluid is supplied to the piston-cylinder assembly.

20. The fluid expander assembly of claim 19, wherein the adjustment assembly varies a circumferential position relative to the longitudinal axis of the drive shaft at which the working fluid is exhausted from the piston-cylinder assembly.

21. The fluid expander assembly of claim 19, further including a first member and a second member each mounted for rotation with the drive shaft, the cylinder being mounted to the first member and the piston being mounted to the second member, and further including a third member mounted about the drive shaft, the working fluid being supplied to and exhausted from the piston-cylinder assembly via communicating openings disposed in the first and third members, the adjustment assembly varying the circumferential positions of the supplying and exhausting of the working fluid by rotating one of the first and third members relative to the other.

22. The fluid expander assembly of claim 21, wherein the adjustment assembly includes a piston-cylinder mounted to the third member for rotating the third member relative to the first member.

23. A fluid expander assembly comprising:

a housing;

a drive shaft mounted for rotation within the housing;

a piston-cylinder assembly mounted for rotation with the drive shaft, the piston-cylinder assembly including a piston and a cylinder for converting energy from a working fluid to rotational energy output via the drive shaft; and an adjustment assembly for varying a circumferential length relative to the longitudinal axis of the drive shaft at which the working fluid is supplied to the piston-cylinder assembly.

24. The fluid expander assembly of claim 23, wherein the adjustment assembly varies a circumferential length relative to the longitudinal axis of the drive shaft at which the working fluid is exhausted from the piston-cylinder assembly.

25. The fluid expander assembly of claim 23, further including a first member and a second member each mounted for rotation with the drive shaft, the cylinder being mounted to the first member, and further including a third member mounted about the drive shaft in sliding contact with the first member, the working fluid being supplied to and exhausted from the piston-cylinder assembly via communicating openings disposed in the first and third members, the adjustment assembly varying the circumferential lengths of the supplying and exhausting of the working fluid by covering or uncovering the opening in the third member.

26. The fluid expander assembly of claim 25, wherein the adjustment assembly includes a fourth member slidably engaging the third member and a drive rod and gearing, the drive rod varying the positions of the fourth member relative to the opening in the third member via the gearing.

27. A fluid expander assembly comprising:

a housing;

a drive shaft mounted for rotation within the housing and having a longitudinal axis;

a first member mounted for rotation with the drive shaft about the longitudinal axis;

a second member mounted for rotation with the drive shaft about an axis adjustably skewed from an orientation parallel to the longitudinal axis of the drive shaft;

a piston-cylinder assembly including a cylinder secured to the first member and a piston secured to the second member and disposed within the cylinder;

a pressurized fluid source for providing pressurized fluid to the piston-cylinder assembly to rotate the drive shaft via the first and second members; and a first adjustment assembly for varying an output torque of the drive shaft by moving one of the first or second members along the longitudinal axis of the drive shaft relative to the other.

28. The fluid expander of claim 27, further including a second adjustment assembly for varying a stroke length of the piston by adjusting the orientation of the axis about which the second rotatable member rotates.

29. The fluid expander of claim 27, further including a second adjustment assembly for selecting a direction of rotation of the drive shaft by varying a circumferential position relative to the longitudinal axis of the drive shaft at which the working fluid is supplied to the piston-cylinder assembly and for varying a circumferential position relative to the longitudinal axis of the drive shaft at which the working fluid is exhausted from the piston-cylinder assembly.

30. The fluid expander of claim 27, further including a second adjustment assembly for varying an output power of the drive shaft by varying a circumferential length relative to the longitudinal axis of the drive shaft at which the working fluid is supplied to the piston-cylinder assembly.

* * * * *